US007976151B2

(12) United States Patent
Tanabe

(10) Patent No.: US 7,976,151 B2
(45) Date of Patent: Jul. 12, 2011

(54) RECORDING SHEET/INK SHEET INTEGRAL CASSETTE AND PRINTER APPARATUS UTILIZING THE SAME

(75) Inventor: Minoru Tanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 957 days.

(21) Appl. No.: 11/668,269

(22) Filed: Jan. 29, 2007

(65) Prior Publication Data

US 2007/0195146 A1 Aug. 23, 2007

(30) Foreign Application Priority Data

Feb. 20, 2006 (JP) ..... 2006-041768

(51) Int. Cl.
*B41J 2/01* (2006.01)

(52) U.S. Cl. ..... 347/104; 347/101

(58) Field of Classification Search ..... 347/104, 347/101, 103; 400/208, 624
See application file for complete search history.

(56) References Cited

U.S. PATENT DOCUMENTS

| | | | | |
|---|---|---|---|---|
| 4,869,606 | A * | 9/1989 | Lehmann et al. | 347/214 |
| 4,914,452 | A | 4/1990 | Fukawa | 346/76 PH |
| 6,069,642 | A * | 5/2000 | Isobe | 347/176 |
| 6,082,913 | A | 7/2000 | Yamamoto et al. | 400/208 |
| 7,242,417 | B2 | 7/2007 | Nishitani et al. | |
| 2005/0212896 | A1 | 9/2005 | Nishitani et al. | |
| 2007/0122221 | A1 * | 5/2007 | Kitamura et al. | 400/120.01 |
| 2007/0195147 | A1 | 8/2007 | Tanabe | 347/104 |

FOREIGN PATENT DOCUMENTS

| | | |
|---|---|---|
| CN | 1205275 | 1/1999 |
| EP | 0 891 871 A2 | 1/1999 |
| EP | 1 580 013 | 9/2005 |
| JP | 2523355 | 5/1996 |
| JP | 11-078187 | 3/1999 |
| JP | 2000-108442 | 4/2000 |
| JP | 2003-029939 | 1/2003 |
| JP | 2005-024793 | 1/2005 |
| JP | 2005-306605 | 11/2005 |
| JP | 2005-335292 | 12/2005 |

OTHER PUBLICATIONS

English Translation of Chinese Office Action issued in Chinese Application No. 200710078933.2 dated Nov. 21, 2008.
Jul. 31, 2007 European Search Report in Application No. 07101914.5-1251.

* cited by examiner

*Primary Examiner* — Manish S Shah
(74) *Attorney, Agent, or Firm* — Fitzpatrick, Cella, Harper & Scinto

(57) ABSTRACT

The recording sheet/ink sheet integral cassette includes a recording sheet containing portion constituted of a substantially rectangular frame member which has a first aperture for sheet feeding, pressurization and recording sheet loading, and a second aperture for feeding the recording sheet to a surface opposed to the first aperture, an ink sheet containing portion for containing an ink sheet to be fed, and an ink sheet winding portion for winding up the ink sheet fed from the ink sheet containing portion. The ink sheet winding portion is positioned along a side of the substantially rectangular shape, the second aperture is positioned on a side opposed to the side, and the ink sheet containing portion is provided along the second aperture, and a third aperture for feeding and driving the recording sheet is provided in an intermediate portion between the ink sheet containing portion and the ink sheet winding portion.

5 Claims, 24 Drawing Sheets

P SIZE

L SIZE

C SIZE

RECORDING SHEET/INK SHEET INTEGRAL CASSETTE AND PRINTER APPARATUS UTILIZING THE SAME

BACKGROUND OF THE INVENTION

1. Field of the Invention

The present invention relates to a recording sheet/ink sheet integral cassette accommodating a recording sheet and an ink sheet, and a printer apparatus utilizing such cassette.

2. Description of the Related Art

Printer apparatuses utilized as an output device of a computer or an output device for a digital image can be classified, according to the recording method, into a thermal transfer printer apparatus, an ink jet printer apparatus, a laser printer apparatus, a wire dot printer apparatus and the like. Among these, a line thermal transfer printer apparatus utilizes an ink sheet and a recording sheet, and based on selectively driving plural heat-generating members arranged along a main scanning direction, while conveying the ink sheet and the recording sheet in a sub scanning direction, thereby forming a print in a dot-line shape on the recording sheet.

Along with the recent progress in the input devices for handling input images, such as a digital camera, a digital video camera, a scanner and the like, the thermal transfer printer apparatus is attracting increasing attention. The thermal transfer printer apparatus is suitable for forming an output print, through a computer or a recording medium, of electronic image information phototaken by a still camera or a video camera recording a still image.

As printer apparatuses of other printing methods such as an ink jet printer apparatus have only a binary selection whether or not to form a dot, and a resolution and a gradation are obtained in apparent manner by forming small dots on the recording sheet and utilizing an error diffusion method or the like. In contrast, in the thermal transfer printer apparatus, a heat amount for controlling a pixel can be changed easily, so that plural gradation levels can be obtained in one pixel. Therefore, such printer apparatus has an advantage of obtaining a smoother image of a higher image quality, in comparison with other printer apparatuses such as an ink jet printer apparatus.

Also the thermal transfer printer apparatus is capable, owing to improvements in the performance of a thermal head as the recording means and the performance of a recording sheet, of providing an image print comparable in quality to a silver halide photograph. Thus, as keeping up with the recent progress in digital cameras, the thermal transfer printer apparatus is attracting attention as a printer particularly for a natural image.

Also recently available is a system for direct print output of captured image information without going through a computer or the like, by directly connecting or integrally constructing the thermal transfer printer apparatus and an image capturing device such as a digital camera or a digital video camera. Such system enables easy photographic printout of image information from the digital camera or the digital video camera, thereby increasing the attention to the thermal transfer printer apparatus. In the thermal transfer system, however, inks of plural colors have to be repeatedly transferred in superposition in order to obtain a full-color print, and a general structure for realizing such transfer will be explained in the following.

A first example of a general structure of the prior thermal transfer printer is shown in FIGS. 32A and 32B. As shown in FIG. 32A, among the recording sheets stacked on a recording sheet cassette 107, an uppermost recording sheet only is separated and fed by a feeding roller 108 and separation means 109 and conveyed to a position between a thermal head 104 and a platen roller 105. A printing operation is executed by winding the recording sheet P on a periphery of the platen roller 105, having an external periphery somewhat longer than the entire length of the recording sheet P, by pressurizing an ink sheet 106 and the recording sheet P by the thermal head 104 and the platen roller 105, and by rotating the platen roller 105 while thermally transferring an ink of the ink sheet 106 onto the recording sheet P by a heat generated by the thermal head 104. Then, after the printing of the first color, in order to print with a next color, the pressurization by the thermal head 104 is released as shown in FIG. 32B, then the platen roller 105 is further rotated to advance the recording sheet P to a print start position, and the second and subsequent colors are printed in operations similar to that for the first color. A full-color printing is achieved by superposing three colors of yellow, magenta and cyan in this manner.

A second example of the general structure of the prior thermal transfer printer is shown in FIGS. 33A and 33B. As shown in FIG. 33A, among the recording sheet P stacked on a paper cassette 201, an uppermost recording sheet only is separated and fed by a feeding roller 202 and separation means 203 and conveyed toward a thermal head 204 and a platen roller 205. A printing operation is executed by pressurizing an ink sheet 206 and the recording sheet P by the thermal head 204 and the platen roller 205, and by conveying the recording sheet P by means of a capstan roller 207 and a pinch roller 208 in pair, provided in a downstream side in the printing direction while thermally transferring an ink of the ink sheet 206 onto the recording sheet P by a heat generated by the thermal head 204.

After the printing of the first color, a next color is printed. For this purpose, the pressurization by the thermal head 204 is released as shown in FIG. 33B, then the capstan roller 207 and the pinch roller 208 are rotated in a direction opposite to that in the printing operation to return the recording sheet P to a print start position, and the second and subsequent colors are printed in operations similar to that for the first color. A full-color printing is achieved by superposing three colors of yellow, magenta and cyan in this manner.

In the example shown in FIGS. 32A and 32B or that shown in FIGS. 33A and 33B, the recording sheet and the ink sheet in the paper cassette are consumables, and have to be replaced and replenished according to the use. The ink sheet is commonly supplied to the user in a cartridge of a structure in which both ends of an ink sheet are wound on two bobbins and in which such two bobbins and the ink sheet are accommodated in a frame member. A numeral 110 in FIGS. 32A and 32B and a numeral 210 in FIGS. 33A and 33B indicate a frame member of such cartridge. The cartridge has a cavity portion as indicated by 110*a* or 201*a*, and, in case of mounting the cartridge, it is guided and mounted in a predetermined position in such a manner that the thermal head 104 or 204, provided in a main body, becomes positioned in such cavity portion of the cartridge.

The two methods above have been used commonly. The first examples involves disadvantages of requiring a platen roller having an external periphery somewhat longer than the entire length of the recording sheet P, thus resulting in a bulky apparatus, and of requiring a mechanism, though not illustrated in FIGS. 32A and 32B, for winding and supporting the recording sheet on the periphery of the platen roller, thus complicating the apparatus. It however has an advantage of not requiring a time for returning the recording sheet as in the second example, since the print start position for the second color is located immediately after when the printing of the first color is completed thus achieving a higher printing speed. On the other hand, the second example involves a disadvantage that the printing time is extended, but has an advantage allowing compactification and simplification of the apparatus.

However, in the thermal transfer printer apparatus described above, in order to obtain a satisfactory print, an exclusive paper having a surface capable of receiving easy transfer of the ink has to be used as the recording sheet. Therefore, an ink cartridge containing an ink sheet corresponding to 50 recording sheets and 50 recording sheets are sold as a set. In the use of the printer, the user is required to go through a trouble of opening a package of the recording sheets and the ink cartridge, sold in a set, and respectively mounting the ink cartridge in the main body and the recording sheets in the paper cassette.

In the thermal transfer printer, a loss in the ink sheet can be reduced by preparing different ink sheets respectively corresponding to the recording sheet sizes as shown in FIG. 34. Therefore, as shown in FIG. 34, for example recording sheets of A6 size and an ink cartridge containing an ink sheet for A6 size are sold as a set, and recording sheets of A7 size and an ink cartridge containing an ink sheet for A7 size are sold as a set. The user purchases these sets according to its purpose, and, in case of executing a printing of A7 size after a printing of A6 size, the user has to remove the A6-sized recording sheets and the ink cartridge for A6 size, and to instead mount the A7-sized recording sheets and the ink cartridge for A7 size.

The A6-sized recording sheets and the ink cartridge for A6 size, removed in this case, have to be stored for a later use. As the ink cartridge and the recording sheets are separate and have to be kept away from dusts and direct sunlight, there is involved a trouble of storing these in a storage bag or the like. In order to avoid these troubles, there is proposed a cartridge integrally containing the ink sheet and the recording sheets as disclosed in Japanese Patent No. 2523355, and Japanese Patent Application Laid-open No. 2000-108442.

However, the cartridge of Japanese Patent No. 2523355, though integrating an ink sheet containing portion and a recording sheet containing portion, has such a structure incapable of executing a printing operation in a state where the ink sheet is accommodated in the cartridge. In order to executing a printing operation, there is required a mechanism of taking out the ink sheet from the cartridge and loading it to a printing position, and such mechanism involves a drawback of complicating the apparatus and lowering the reliability.

Japanese Patent Application Laid-open No. 2000-108442 proposes an improvement over the drawback of Japanese Patent No. 2523355. In this proposal, the integral cartridge, after being mounted, is capable of executing a printing operation with the ink sheet not loaded to the printing position but in the mounted position. It is thus so structured that the user does not feel the trouble of mounting the ink sheet and the recording sheets separately in the printer apparatus and, in case of using the recording sheet of different types, of removed ink sheet and recording sheets separately.

However, in the case that a photographic printing is a prime object, the paper to be used requires a certain thickness in order to secure a storability, a durability and a print quality. Therefore, a extreme bending of the paper during the conveyance for printing may cause a damage or creases on a printing surface. Also in a case where the recording sheet has a large thickness, the reliability of separation of the recording sheet from the cassette may be lowered, depending on the separating method, unless a space for sufficiently bending the recording sheet is made available.

In Japanese Patent Application Laid-open No. 2000-108442, a conveying path for the paper is formed in the cassette, and the external shape thereof is formed with an arc of a certain large radius R in order to avoid an extreme bending, for suppressing the damage to the paper and improving the reliability in conveyance. However the interior of such R-shape, for forming the conveying path, forms a wasted space. Also in order to obtain a smooth bending in the conveying path, the cassette requires a certain size in the thickness direction, and gives a limit in the compactification. As a result, the cassette exceeds the minimum necessary size required for containing the ink sheet of the papers, and leads to a bulkiness of the main body of the printer.

SUMMARY OF THE INVENTION

In consideration of the point described above, an object of the present invention is to provide a recording sheet/ink sheet integral compact cassette that has a high reliability in paper separation, minimizes the damage to the paper with a high reliability in the conveyance thereof, and provides a high usability, and a printer apparatus utilizing such cassette.

The aforementioned object is accomplished, according to the present invention, by a recording sheet/ink sheet integral cassette including a recording sheet containing portion constituted of a substantially rectangular frame member which has a first aperture for sheet feeding, pressurization and recording sheet loading, and a second aperture for feeding the recording sheet to a surface opposed to the first aperture, an ink sheet containing portion for containing an ink sheet to be fed, and an ink sheet winding portion for winding up the ink sheet fed from the ink sheet containing portion, wherein the ink sheet winding portion is positioned along a side of the substantially rectangular shape, the second aperture is positioned on a side opposed to the above-mentioned side, and the ink sheet containing portion is provided along the second aperture, and a third aperture for feeding and driving the recording sheet is provided in an intermediate portion between the ink sheet containing portion and the ink sheet winding portion.

A printer apparatus of the present invention includes a cassette containing portion for positioning and containing a recording sheet/ink sheet integral cassette which contains a recording sheet containing portion for loading a recording sheet, an ink sheet containing portion for containing an ink sheet to be fed, and an ink sheet winding portion for winding up the ink sheet fed from the ink sheet containing portion, pressurization means which pressurizes the recording sheet, loaded in the recording sheet containing portion, to a conveying position, first conveying means and a thermal head for printing on the recording sheet, which are so provided, when the cassette is contained in the cassette containing portion, as to be in a position between the ink sheet containing portion and the ink sheet winding portion in order to feed and convey the recording sheet pressurized by the pressurization means, second conveying means which conveys the fed and conveyed recording sheet toward the thermal head, and third conveying means which conveys the ink sheet from the ink sheet containing portion toward the ink sheet winding portion in order to execute printing on the recording sheet, conveyed toward the thermal head, by means of the thermal head.

According to the present invention, the printing operation is enabled by simply mounting the recording sheet/ink sheet integral cassette on the printer apparatus, so that the printing operation can be executed easily within a short time. Also a sheet feeding roller is provided in a heat unit to achieve compactification of the printer apparatus, and an efficient pressurization is achieved by an aperture for loading and pressurizing the recording sheet, provided at the opposed side.

Also the recording sheet, after being fed from the third aperture and reversed in the conveying direction, is printed and conveyed, thereby dispensing with wasteful conveying path and components and attaining compactification of the entire apparatus. Also the recording sheet containing portion is provided with a separating pawl capable of separating the stacked recording sheets, thereby improving the reliability of sheet separation and avoiding the dropping of the recording sheet from the cassette when it is kept alone. Also the recording sheet is improved in the reliability of separation and is prevented from an extreme bending but only mildly bent whereby the damage to the recording sheet can be minimized.

Thus the present invention enables to obtain a recording sheet/ink sheet integral compact cassette of a high usability and a printer apparatus utilizing such cassette.

Further features of the present invention will become apparent from the following description of exemplary embodiments with reference to the attached drawings.

DESCRIPTION OF THE EMBODIMENTS

Now embodiments of the present invention will be explained with reference to the accompanying drawings.

Figure 1:
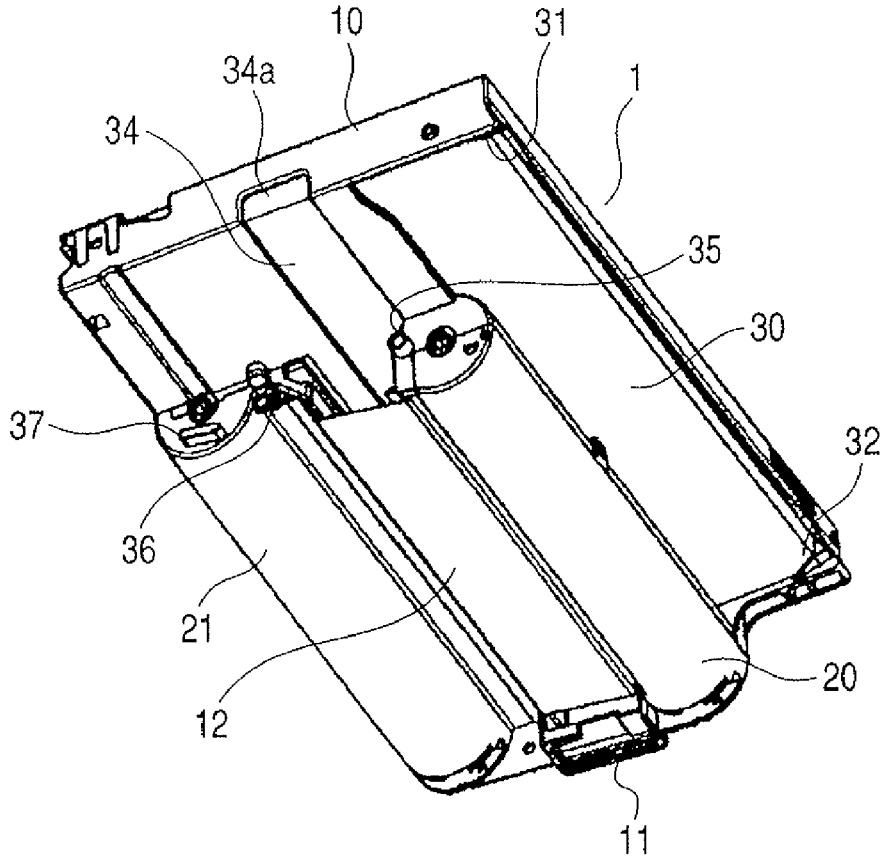
FIG. 1 is a view showing a recording sheet/ink sheet integral cassette of the present invention.

Structure of a recording sheet/ink sheet integral cassettes of the present invention will be explained with reference to FIGS. 1 and 2. Referring to FIG. 1, a numeral 1 indicates an entire recording sheet/ink sheet integral cassettes of the present invention, and 10 indicates an upper case as a housing principally stacking and containing recording sheets. 11 indicates a lower case constituting an ink sheet containing portion in cooperation with the upper case 10, 20 indicates a supply side containing portion (first protruded portion) for containing the ink sheet before printing, and 21 indicates a winding side containing portion (second protruded portion) for containing the ink sheet after printing.

30 indicates a feeding opening or a feeding aperture (second aperture) for taking out the recording sheets one by one from the cassette, and such aperture is adjacent to the supply side containing portion 20 and forms, at an end portion of the recording sheet containing portion, a substantially rectangular aperture over an entire longitudinal direction of the recording sheet. On both ends of the feeding opening 30, separating pawls 31, 32 are provided for separating the recording sheets one by one. The upper case 10 constituting the frame member or the first case, and the lower case 11 constituting the second case are formed by an injection molding of a plastic material, in order to achieve a cost reduction.

Figure 2:
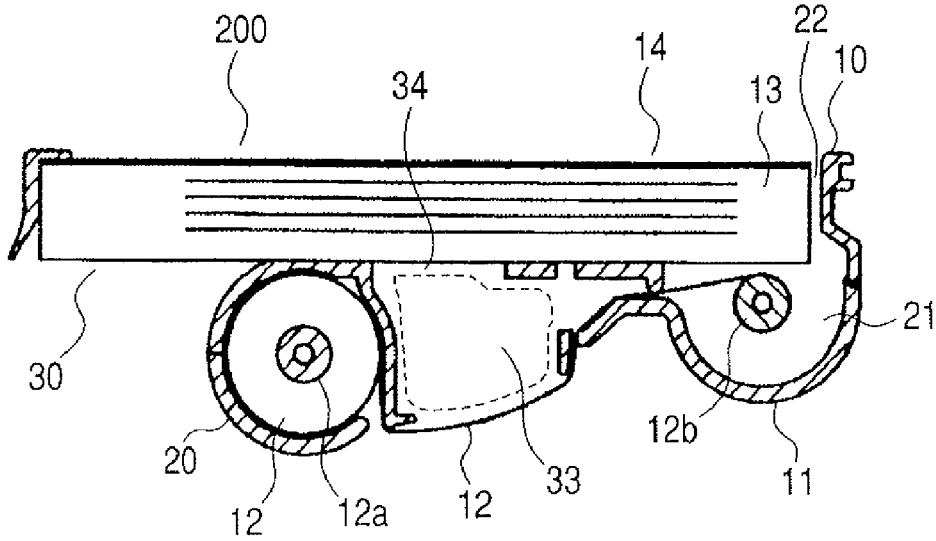
FIG. 2 is a cross-sectional view of the recording sheet/ink sheet integral cassette of the present invention.

FIG. 2 is a cross-sectional view along a direction perpendicular to an axial direction of a winding shaft of the ink sheet. Referring to FIG. 2, 12 indicates a belt-shaped ink sheet, which is wound on a first bobbin 12*a* constituting a first shaft, and of which a leading end is fixed, for example by adhering, on a second bobbin 12*b* constituting a winding second shaft. The ink sheet 12 is contained in an ink sheet containing portion, formed between the upper case 10 and the lower case 11, and the first bobbin 12*a* is accommodated in a supply side containing portion 20 while the second bobbin 12*b* is accommodated in a winding side containing portion 21. The first bobbin 12*a* and the second bobbin 12*b* are so positioned as to be parallel to the surface of the recording sheet, contained in the recording sheet containing portion.

13 indicates recording sheets, which are contained in the recording sheet containing portion 22 of the upper case 10, in a stacked state by a number equal to a number printable by the ink sheet 12. For example, when the ink sheet 12 is wound in an amount for 50 image frames, the recording sheets 13 are stacked also in a number of 50 sheets. Therefore, in the recording sheet/ink sheet integral cassette of the present invention, after printings for example of 50 images, the recording sheets and the ink sheet are used up simultaneously, and neither of these will be used up earlier. Therefore, it is unnecessary to replenish or replace either one only, and the user is only required to execute a replacement in the unit of a cassette when it is used up, whereby the replacing operation can be simplified.

200 indicates an upper aperture (loading aperture or first aperture) for loading the recording sheets 13 and a protective sheet into the upper case 10, and, in case of executing a printing operation by mounting the cassette 1 in the printer, the upper aperture 200 is used for pressurization. The upper aperture 200 is provided at a side opposite to the feeding opening 30.

14 indicates a protective sheet for preventing the recording sheets 13 from stain or damage, which has an external shape substantially same as that of the recording sheet 13 and is contained in the recording sheet containing portion 22 in a state superposed on an uppermost part of the recording sheets 13. As shown in FIG. 2, a space 33 is formed between the ink sheet 12 and the recording sheets 13, and a head unit to be explained later is to be positioned in such space, when the cassette is mounted in the printer. Also an aperture 34 is provided in an intermediate portion of the upper case 10, between the supply side containing portion 20 and the winding side containing portion 21. The aperture 34 extends over the substantially entire area of the longitudinal direction of the recording sheet containing portion 22, and is also connected, as shown in FIG. 1, with a lateral aperture 34*a* provided on a lateral face of the upper case 10.

Referring to FIG. 1, 35 indicates a first positioning hole provided on an end face of the supply side containing portion 20 for the ink sheet, and 36 indicates a second positioning hole provided on an end face of the winding side containing portion 21. These positioning holes 35, 36 are fitted with positioning shafts in the main body of the printer, when the cassette 1 is mounted on the printer, to define the positions around the winding shafts of the ink sheet, thereby stabilizing the running and winding of the ink sheet.

37 indicates a cassette identifying protrusion, which is made different in shape, according to the type of the cassette. The cassette identifying protrusion 37 has a different shape of protrusion, for each size of the recording sheet or for each type of the ink sheet. A sensor serving as identification means in the main body of the printer identifies the cassette identifying protrusion 37 to control the conveying or printing of the recording sheet, according to such type of the recording sheet and the of the ink sheet.

Figures 16A, 16B, 16C:
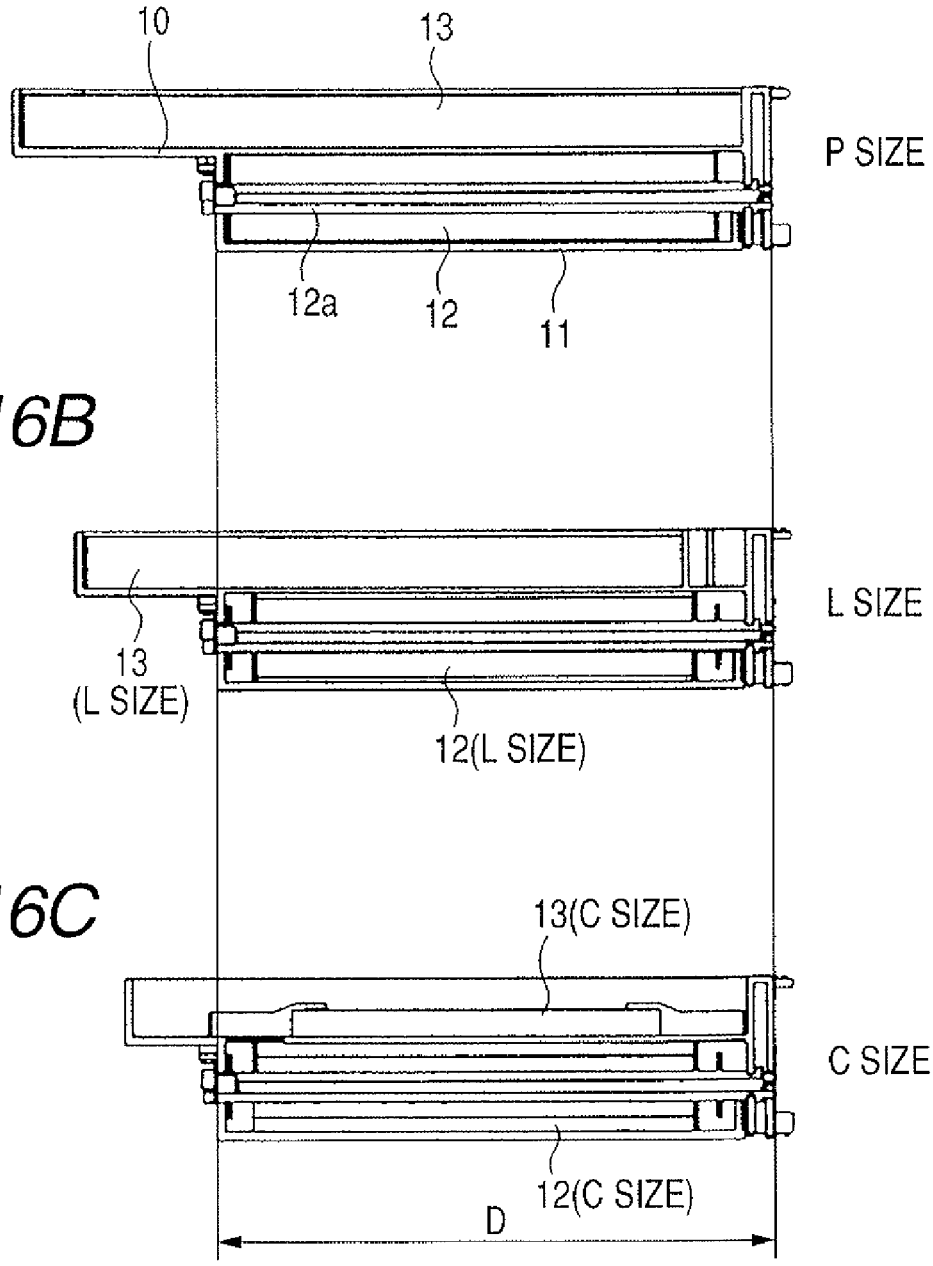
FIGS. 16A, 16B and 16C are views showing recording sheet/ink sheet integral cassettes of the present invention of 3 types, different in sizes of recording sheets therein.

Now reference is made to FIGS. 15A to 15C and FIGS. 16A to 16C, for explaining the types of the cassette. FIGS. 15A to 15C and FIGS. 16A to 16C illustrate cassettes of 3 types different in the size of the recording sheet, and FIGS. 15A 15B and 15C or FIGS. 16A, 16B and 16C respectively show cassettes of a post size, an L-size and a card size. FIGS. 16A to 16C are cross-sectional views at the supply side containing portion, seen from the side of the feeding opening 30. As shown in FIGS. 15A to 15C and 16A to 16C, the recording sheet containing portion 22 of the upper case 10 has a dimension D different along the winding shaft of the ink sheet, depending on the size of the recording sheet, but has a same dimension in a direction perpendicular to the ink sheet winding shaft.

Also the portion containing the ink sheet 12, principally formed by the lower case 11, has a same dimension in either direction, regardless of the size of the recording sheet. The aforementioned positioning holes 35, 36 are provided on the end faces of the ink sheet containing portion, and the cassette identification protrusion is also provided on the end face of the ink sheet containing portion. Also as shown in FIGS. 16A to 16C, the shaft for winding the ink sheet 12 has a same total length, though the width dimensions of ink sheet 12 thereof is different for different recording sizes.

Figure 3:
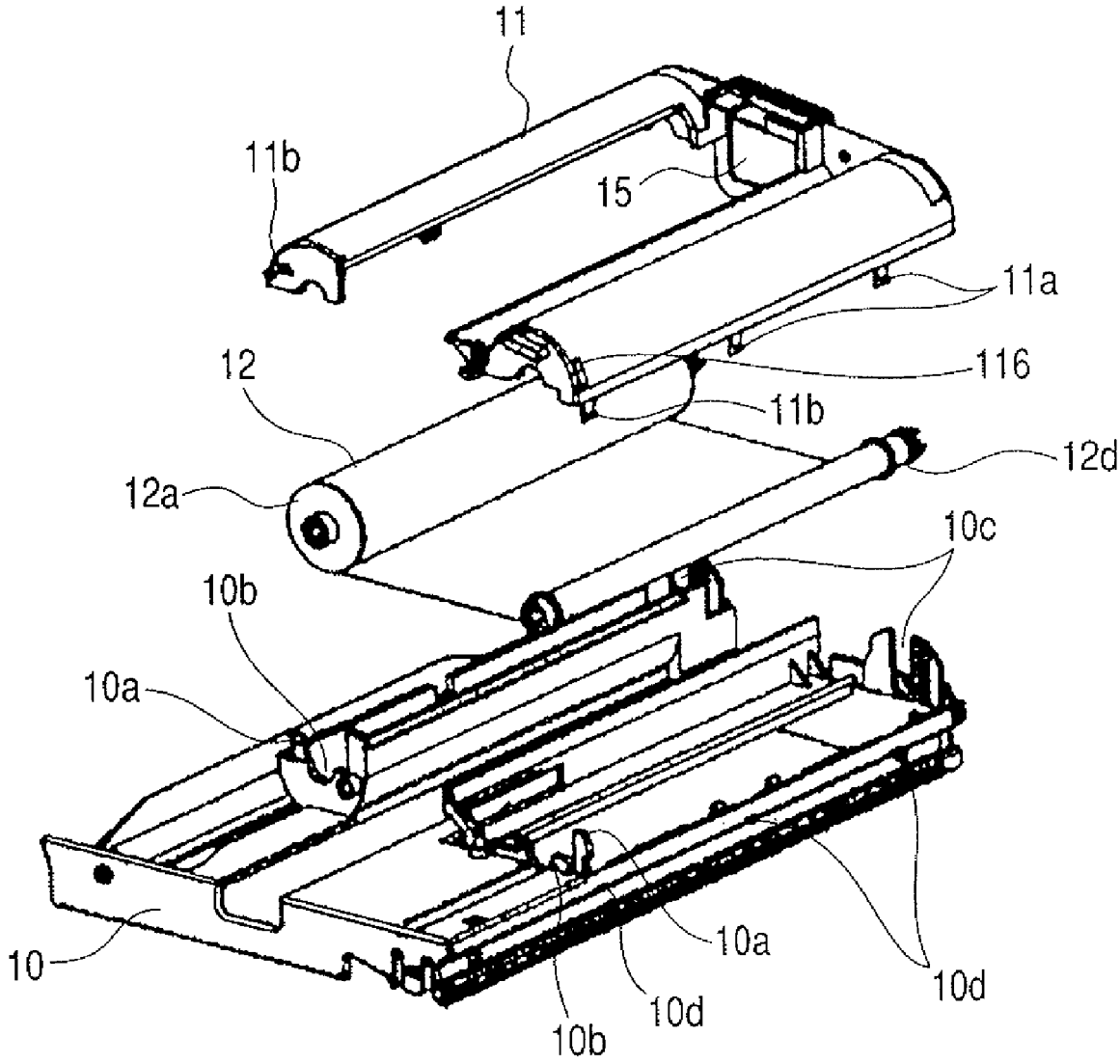
FIG. 3 is a view showing an assembling method for the recording sheet/ink sheet integral cassette of the present invention.

Now reference is made to FIGS. 3, 4A, 4B, 5 and 6 for explaining an assembling method for the recording sheet/ink sheet integral cassette 1 of the present invention. At first, as shown in FIG. 3, on the upper case 10 placed in a state where the recording sheet containing portion 22 is positioned downwards, the first bobbin 12*a* and the second bobbin 12*b* of the ink sheet 12 are respectively dropped onto semi-circular recesses 10*b* and U-shaped recesses 10*c* of the upper case 10. Then the lower case 11 is assembled onto the upper case 10 from above, whereby pawls 10*a* of the upper case 10 engage with holes 11*b* of the lower case 11 and pawls 11*a* of the lower case 11 engage with holes 10*d* of the upper 10 to combine the upper case 10 and the lower case 11. Though not illustrated in the drawing, similar pawls and holes are provided in rear portions, whereby a principal part of the lower case 11 is fixed to the upper case 10.

Figure 4A:
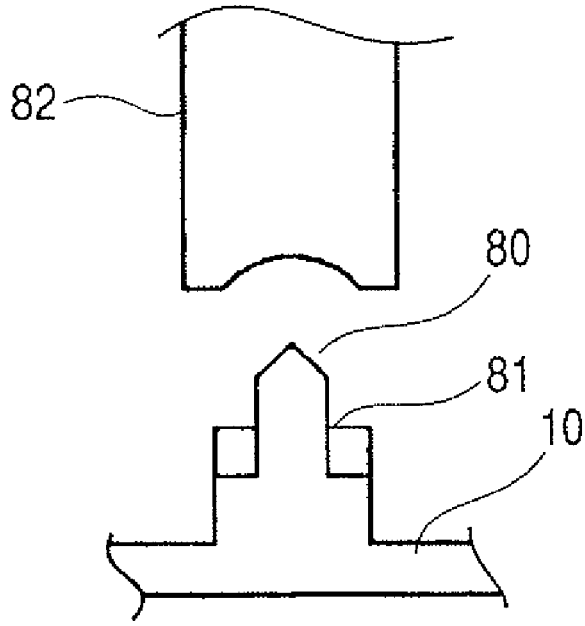
FIGS. 4A and 4B are views showing an assembling method for the recording sheet/ink sheet integral cassette of the present invention.

Also in the recording sheet/ink sheet integral cassette of the present invention, a fusion shaft 80 provided on the upper case 10 and a fusion hole 81 provided in the lower case 11 are combined by thermal fusion. Details will be explained in FIGS. 4A and 4B. FIG. 4A shows a state where the ink sheet 12 and the lower case 11 shown in FIG. 3 are assembled to the upper case 10, and, in such state, the fusion shaft 80 of the upper case 10 penetrates in the fusion hole 81 of the lower case 11. In such state, a terminal end 82 of a fusing tool presses, under a predetermined load, the end of the fusion shaft 80 to deform the end of the fusion shaft 80, whereby, as shown in FIG. 4B, the fusion shaft 80 becomes to have an external diameter 80*a* larger than the fusion hole 81 and closely contacts the lower case 11 from above, thereby achieving a firm fixation.

Figure 4B:
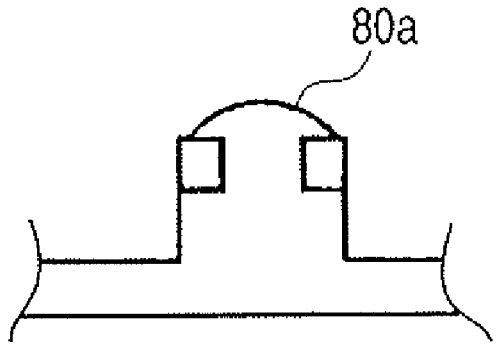

In FIGS. 4A and 4B, the terminal end 82 of the fusing tool has a recessed shape of a sphere R, so that the shape 80*a* after the deformation of the fusion shaft 80 assumes a spherical shape R, but, when the terminal end 82 has a flat shape, the fusion shaft 80 is deformed into a flat shape, and a similar effect can be obtained also in such case. Also the terminal end 82 may be of a type provided with a heater or a type causing a vibration in the fusion shaft 80 to generate heat therein by an ultrasonic vibration, and, since the fusion shaft 80 has a conically shaped end portion, the deformation is induced from the conically pointed end.

Figure 5:
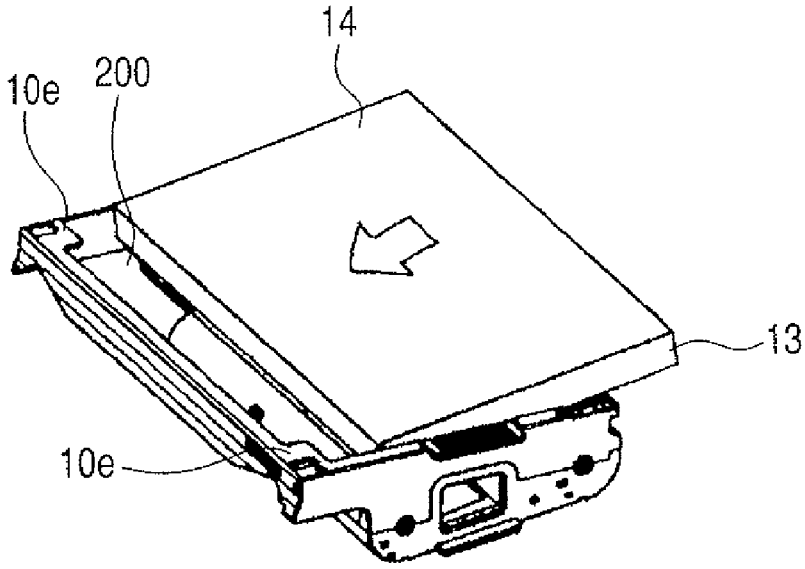
FIG. 5 is a view showing an assembling method for the recording sheet/ink sheet integral cassette of the present invention.
Figure 6:
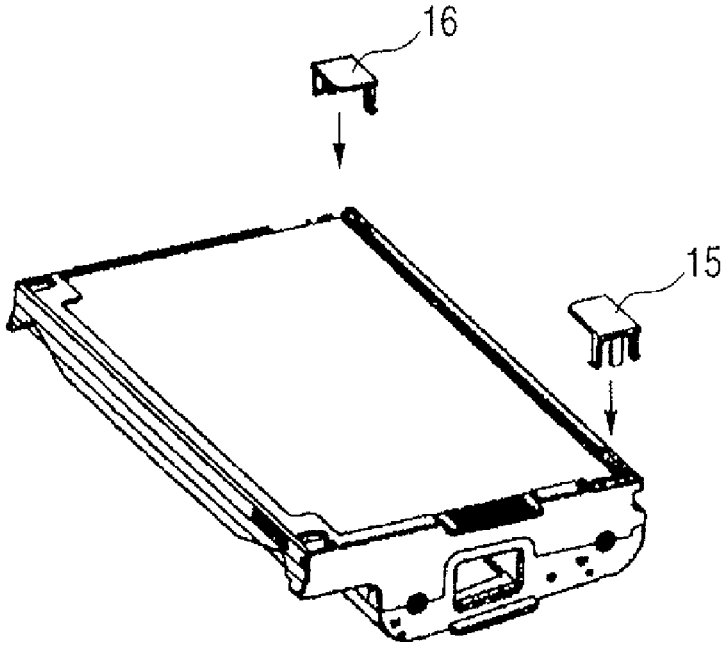
FIG. 6 is a view showing an assembling method for the recording sheet/ink sheet integral cassette of the present invention.

Now assembling of the recording sheets 13 and the protective sheet 14 will be explained with reference to FIG. 5. After the ink sheet 12 and the lower case 11 are assembled to the upper case 10, 50 recording sheets 13 and one protective sheet 14 in a superposed state are inserted, in an inclined direction, from the upper aperture 200 to a rear side of two pressing portions 10*e* in the corners. In this operation, the recording sheets 13 do not drop from the feeding aperture 30, by the presence of two separating pawls 31, 32 provided at the corners of the feeding aperture 30.

After the recording sheets and the protective sheet 14 are loaded in the upper case 10, pressing members 15, 16 are mounted in remaining two corner portions of the upper case 10, whereby the recording sheets 13 are supported in 4 corner portions and contained in the recording sheet containing portion 23 so as not to drop therefrom. The pressing members 15, 16 are also formed by a resinous material, and are mounted to the upper case 10 by pawls utilizing an elastic deformation of the resinous material. As explained in the foregoing, the recording sheet/ink sheet integral cassette of the present invention stores the recording sheets and the ink sheet by two principal parts, namely the upper case 10 and the lower case 11, thus not requiring a large number of component parts also achieving compactification.

Figure 7:
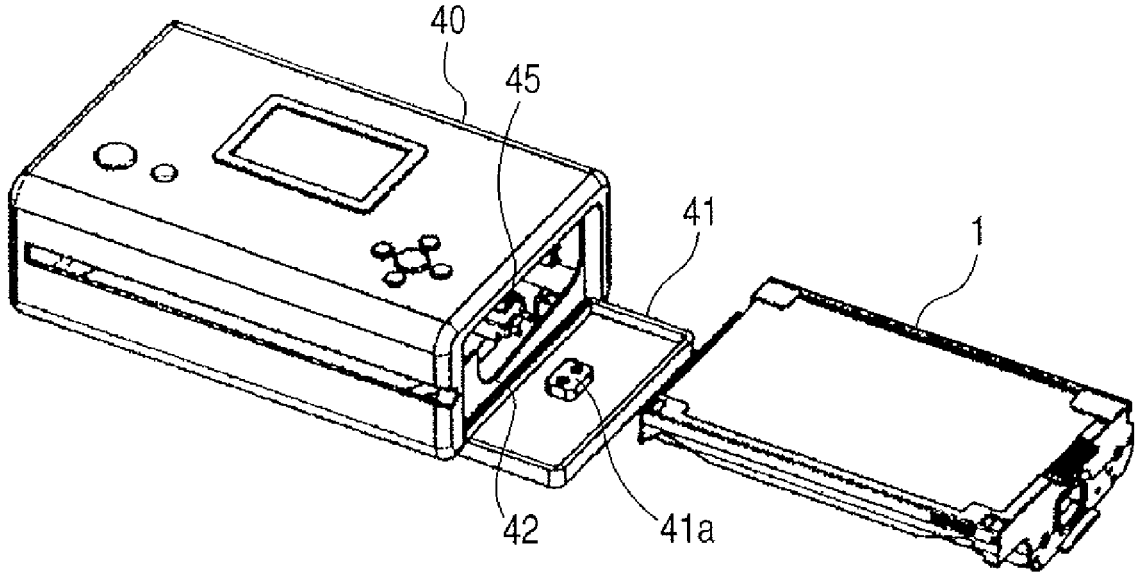
FIG. 7 is a view showing a printer utilizing the recording sheet/ink sheet integral cassette of the present invention.

Now reference is made to FIG. 7, for explaining a printer utilizing the recording sheet/ink sheet integral cassette of the present invention. In FIG. 7, 40 indicates a main body of the printer, in a state where a door 41 on a lateral face is opened, thereby exposing a cassette inserting port 42 for mounting or detaching the cassette. The cassette inserting port 42 is an aperture of a shape substantially same as and somewhat larger than the cross-sectional shape of the cassette 1. In the cassette inserting port 42, an end portion of a head unit 45 is visible.

Figure 8:
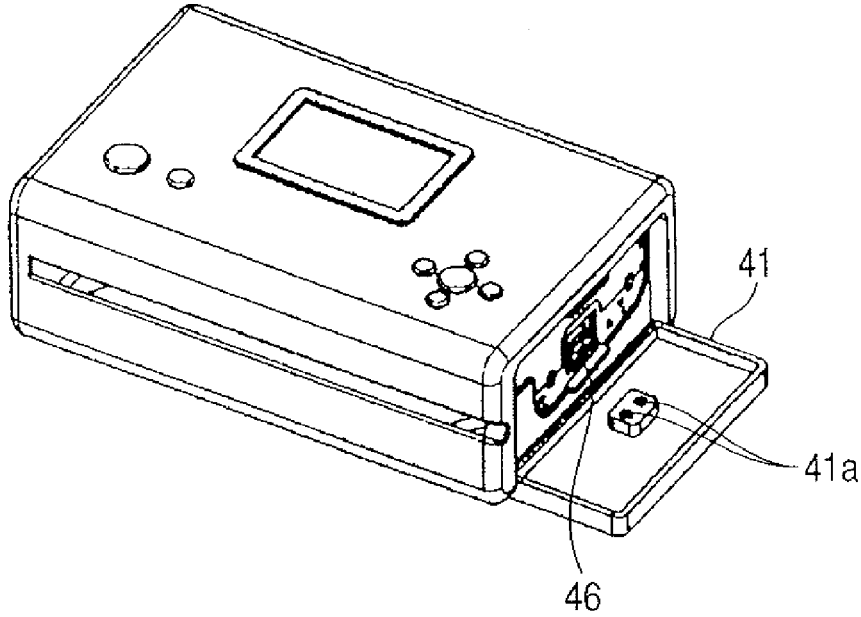
FIG. 8 is a view showing a printer utilizing the recording sheet/ink sheet integral cassette of the present invention.

FIG. 8 shows a state where the cassette 1 is inserted into the cassette inserting port 42. As shown in FIG. 8, when the cassette 1 is inserted into the main body of the printer, the end portion of the head unit 45 is slightly exposed from the aperture 15 of the cassette 1, whereby a shaft 46 provided at the end of the head unit 45 protrudes by a predetermined amount from the cassette 1. When the door 41 is closed from this state, an engaging hole 41*a* provided on an internal face of the door 41 is fitted with the shaft 46 to define the end position of the head unit 45, whereby the printer is enabled for use.

Figure 9:
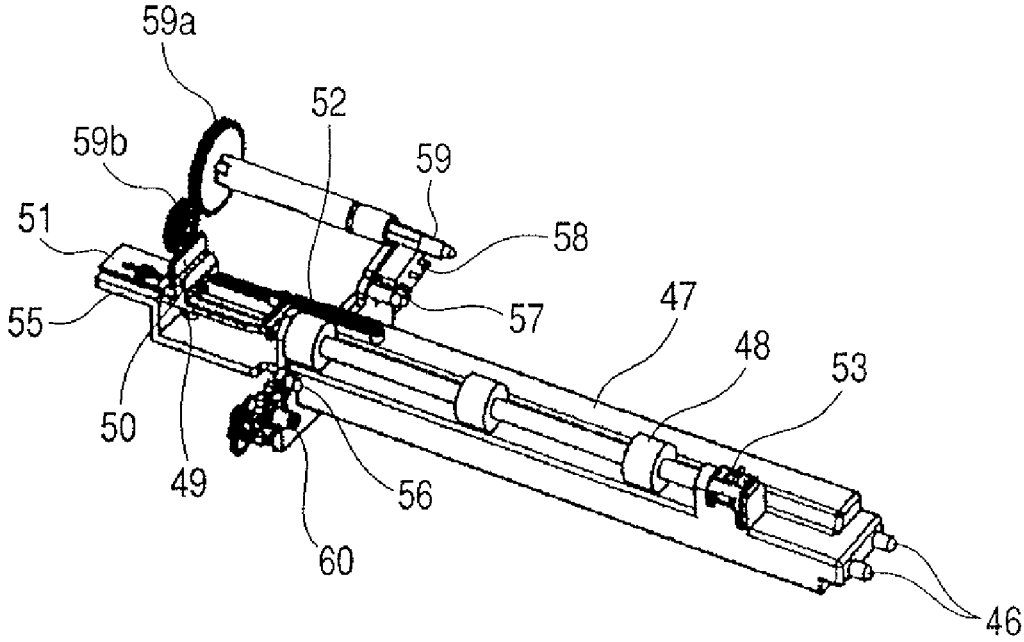
FIG. 9 is a view showing a thermal head unit of the printer utilizing the recording sheet/ink sheet integral cassette of the present invention.

FIG. 9 shows a thermal head unit 45 of the printer utilizing the recording sheet/ink sheet integral cassette of the present invention. 47 indicates a thermal head, which is electrically connected with a printed control circuit board in the main body. 48 indicates a sheet feeding roller serving as feeding means, of which a shaft 48*a* is rotatably supported, on both ends thereof, on the head unit 45. On an end of the shaft 48*a*, a gear 49 is so mounted as to integrally rotate with the shaft 48*a*, and rotates the feeding roller 48 by means of an unillustrated connecting gear.

50 indicates an urging member for urging the recording sheet in the cassette, toward right in the drawing. The urging member 50 is fitted, at an end portion 50*a*, with the shaft 48*a*, while the other end is supported by a rail 51 fixed to a head frame 55, slidably in the mounting direction of the cassette, and is urged by a spring 52 toward the cassette inserting port 42.

Figure 10:
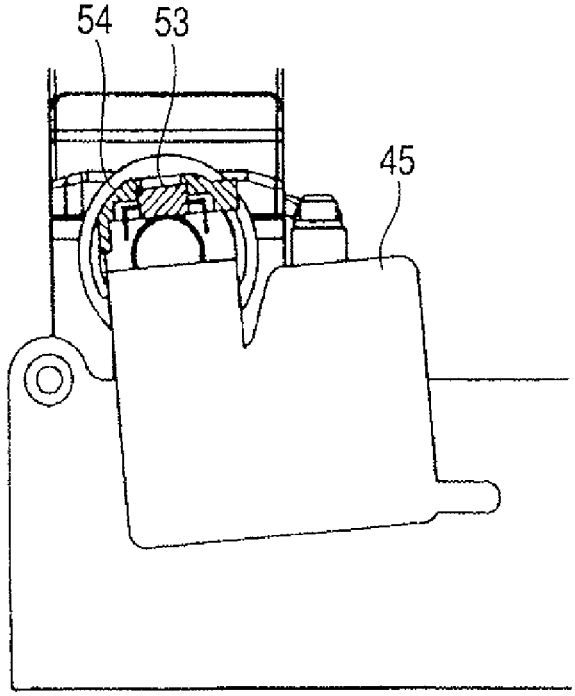
FIG. 10 is a cross-sectional view showing a mounting state of a photoreflector.

53 indicates a photoreflector (detection means) for detecting presence/absence of the recording sheet in the cassette, and is mounted on the head unit 45 by a holder 54. FIG. 10 is a cross-sectional view showing a mounting state of the photoreflector 53. As shown in FIG. 10, the photoreflector 53 is mounted, with a light emitting/receiving portion thereof upwards, on the head unit 45 and is fixed by placing a holder 54 thereon.

56 and 57 indicate a first positioning shaft and a second positioning shaft for positioning the cassette 1, when the cassette 1 is mounted in the main body of the printer. These engage with the first positioning hole 35 and the second positioning hole 36 provided on the cassette 1, when the cassette 1 is mounted, thereby defining the position of the cassette 1 within the main body of the printer.

58 indicates a cassette identification switch for identifying the type of the cassette, and the type of the cassette is identified by the shape of the protrusion provided on the cassette 1, when the cassette 1 is mounted in the main body of the printer.

59 indicates a winding shaft which engages with the second bobbin 12*b* of the cassette 1 when the cassette 1 is mounted in the main body of the printer and winds up the ink sheet 12 at the printing operation. The winding shaft 59 is linked with gears 59*a*, 59*b* and is so controlled to rotate at a predetermined speed at the printing operation. 60 indicates an idler shaft to be rotated when the ink sheet 12 is wound up, serving for example to detect the rotation and to confirm whether the ink sheet 12 is securely fed.

Figure 11:
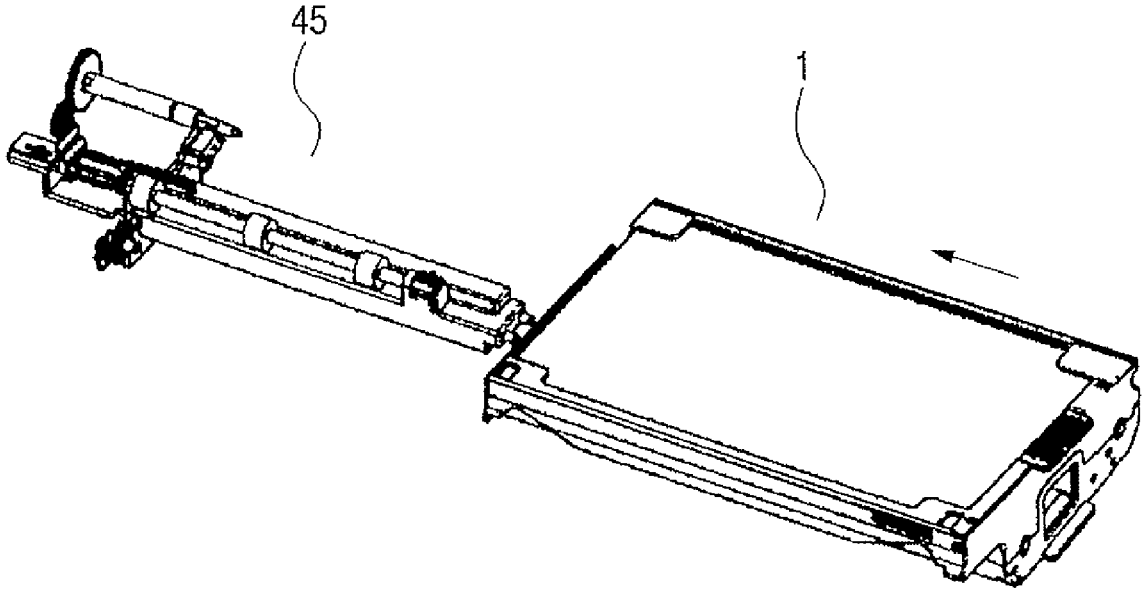
FIG. 11 is a view showing a state of mounting of the cassette into the head unit.

The head unit 45 is provided in the main body of the printer 40, and states of mounting of the cassette 1 with respect to the head unit 45 will be explained with reference to FIGS. 11, 12 and 13. The cassette 1 is mounted into the printer 40, along a direction indicated by an arrow in FIG. 11. In this state, the head unit 40 enters the space 33 between the ink sheet 12 and the recording sheets 13 shown in FIG. 2.

Figure 12:
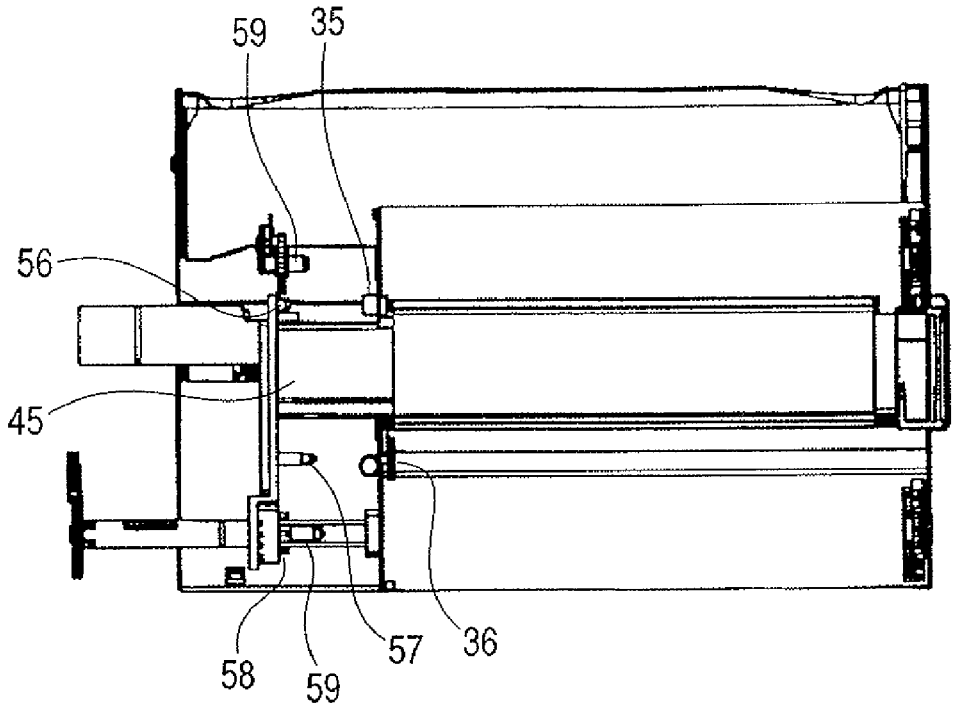
FIG. 12 is a view showing a state of mounting of the cassette into the head unit.
Figure 13:
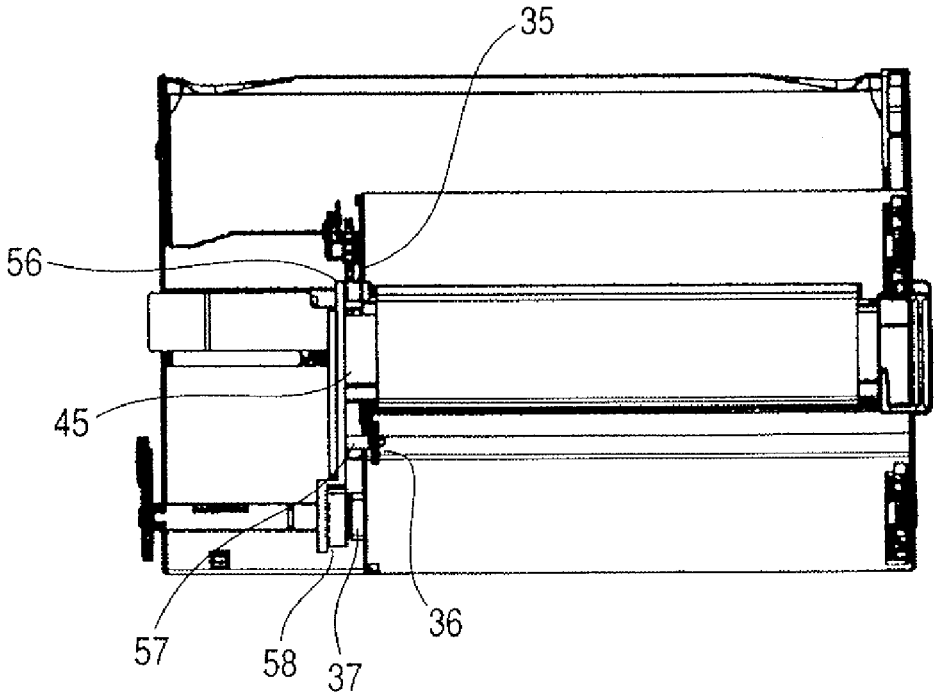
FIG. 13 is a view showing a state where the cassette is mounted with respect to the head unit in the printer.
Figure 14:
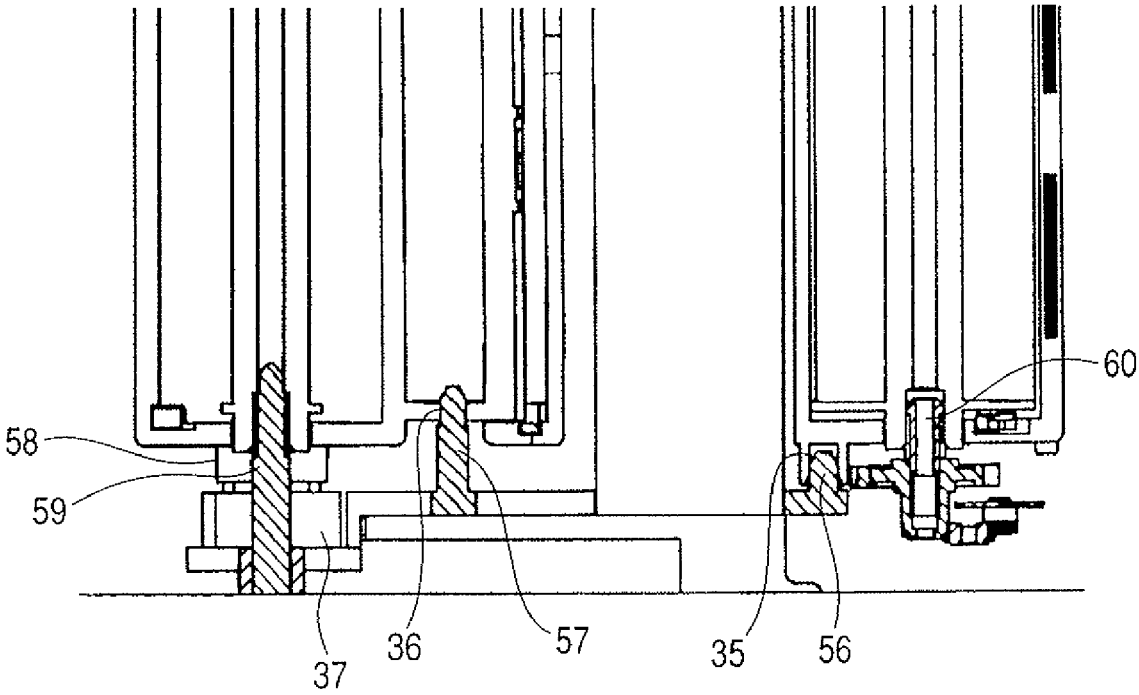
FIG. 14 is a view showing a state where the cassette is mounted with respect to the head unit in the printer.
Figure 15A:
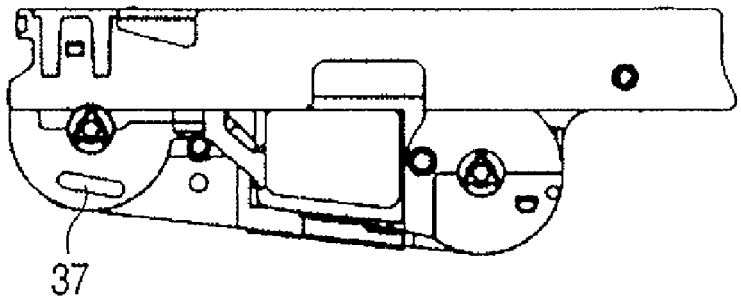
FIGS. 15A, 15B and 15C are views showing recording sheet/ink sheet integral cassettes of the present invention of 3 types, different in sizes of recording sheets therein.
Figure 15B:
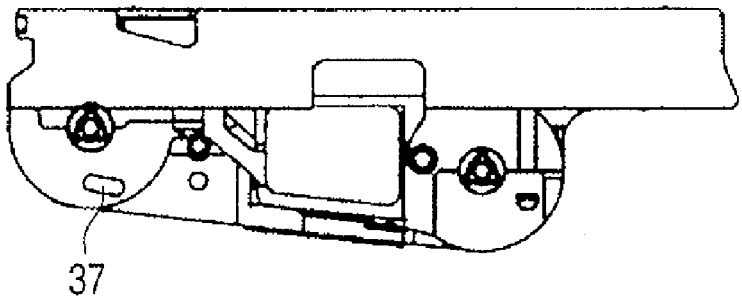
Figure 15C:
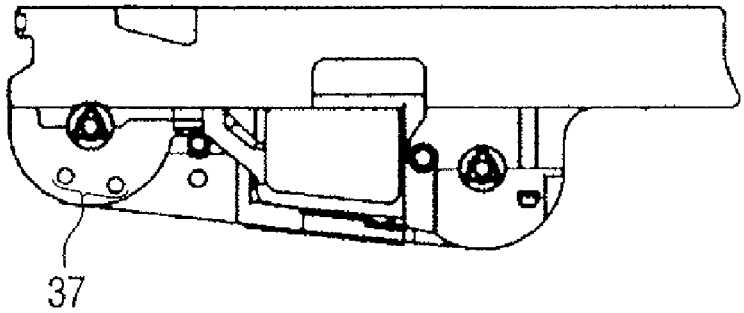

FIG. 12 is a view showing such state seen from the rear side of the cassette 1. As shown in FIG. 12, the head unit 45 enters the space 33, positioned above the ink sheet 12 and below the recording sheets 13. FIG. 13 shows a state where the cassette 1 is completely mounted, and FIG. 14 is a cross-sectional view showing details of such state. In FIGS. 13 and 14, the first positioning shaft 56 and the second positioning shaft 57 respectively fit in the first positioning hole 35 and the second positioning hole 36. Also the winding shaft 59 is fitted with the second bobbin 12*b*, and the idler shaft 60 is fitted with the first bobbin 12*a*. Also the cassette identification switch 58 is pressed by the cassette identification protrusion 37.

As the positioning holes 35, 36 and the cassette identification projection 37 are in same positions even for a different type of the cassette, the positioning shafts 56, 57 and the cassette identification switch in the main body of the printer need not be provided in plurality. Also as the first bobbin 12*a* and the second bobbin 12*b* have a same total length, the winding shaft 59 and the idler shaft 60 need not be made variable in total length or position thereof.

Thus, even in cassettes having plural recording sheet sizes or plural sizes of the ink sheet 12, the ink sheet containing portion is given a same external dimension, and the positioning holes 35, 36 and the cassette identification projection 37 are provided in the ink sheet containing portion. Also the first bobbin 12*a* and the second bobbin 12*b* are given a same total length thereby simplifying the internal structure of the main body of the printer.

Figure 17:
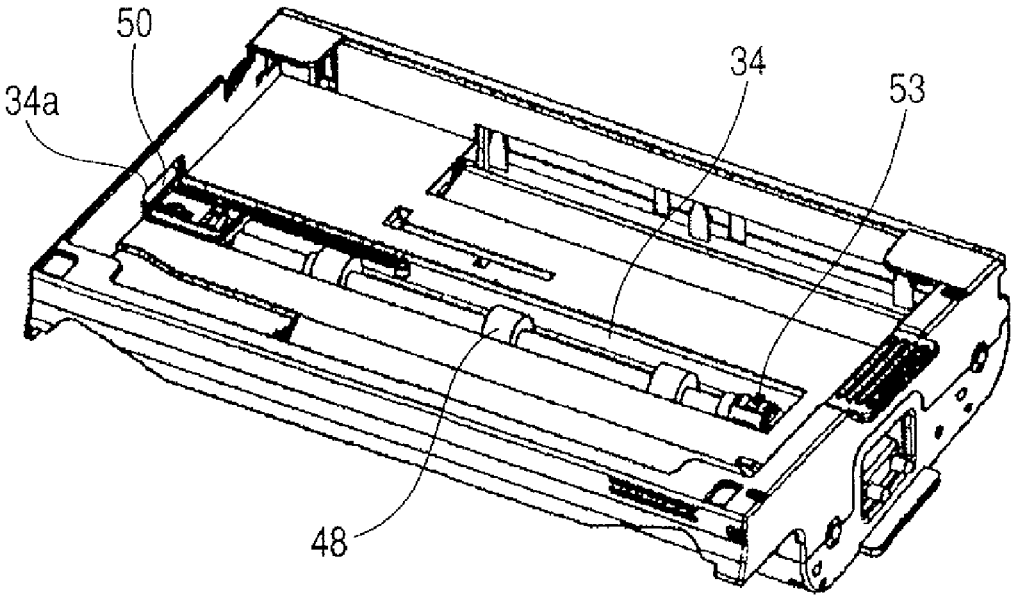
FIG. 17 is a view showing the cassette in a state mounted in the printer, with the recording sheet and a protective sheet being omitted.

FIG. 17 shows a state where the cassette 1 is completely mounted in the printer 40, in which the recording sheet 13 and the protective sheet are omitted for the purpose of clarity. As shown in FIG. 17, the feeding roller 48 and the photoreflector 53 are positioned within the aperture (third aperture) 34 of the upper case 10. Also the urging member 50 is positioned inside the lateral aperture 34*a*.

Figure 18:
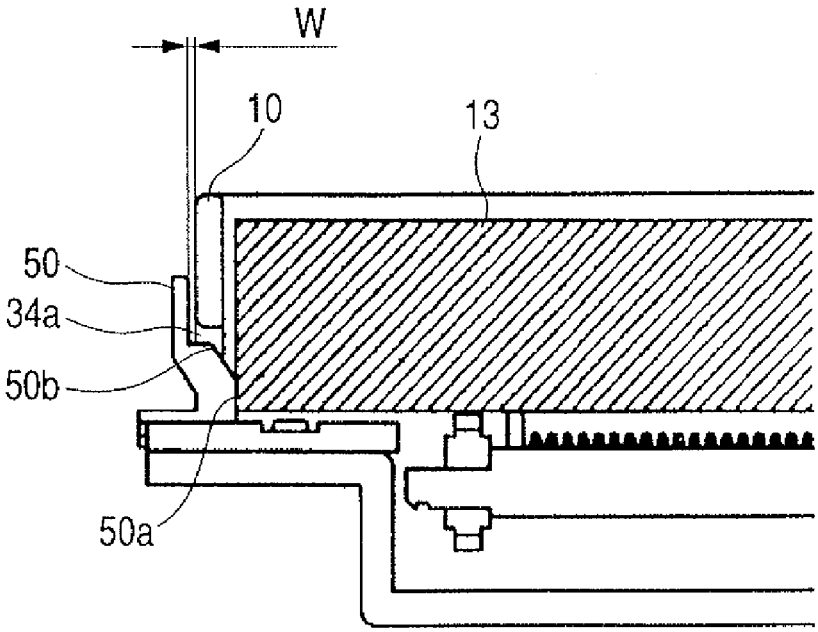
FIG. 18 is a cross-sectional view showing a positional relationship among an urging member, the cassette and the recording sheet.

FIG. 18 is a cross-sectional view showing the positional relationship of the urging member 50, the cassette 1 and the recording sheets 13. In FIG. 18, the urging member 50 is urged toward right by the spring 52 as described above, and an impinging face 50*a* protrudes through the lateral aperture 34*a* into the interior of the upper case 10 and impinges on the end face of the recording sheet 13. In this state, because of a gap w provided to the external lateral face of the upper case 10, the recording sheet 13 is securely urged toward right in the drawing. An inclined surface 50*b* where the urging member 50 is provided serves, when the recording sheets 13 are fed in succession from the lowermost one to smoothly guide the recording sheet, moving from above to below in the drawing, to the impinging face 50*a*.

Figure 20A:
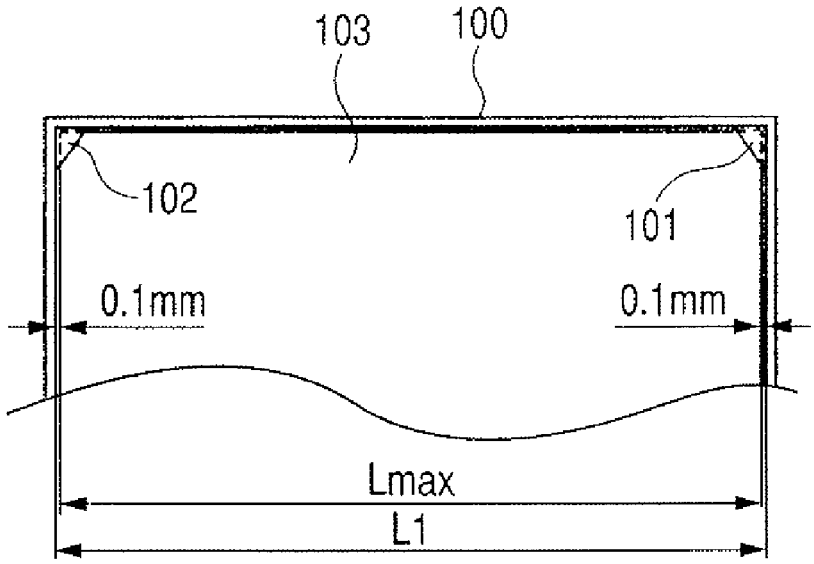
FIGS. 20A and 20B are views showing a relationship between a separating pawl and a recording sheet, in case of a cassette not employing an urging member.
Figure 20B:
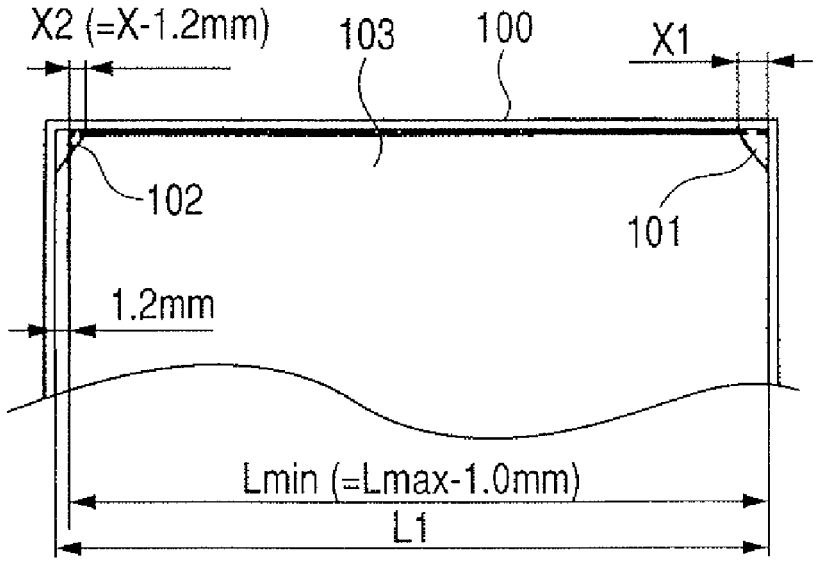

Then the function of the urging member 50 will be explained. FIGS. 20A and 20B are views, simplified for the purpose of clarity, showing a relationship between the separating pawl and the recording sheet, in an example of a cassette not employing the urging member 50. In FIG. 20A, 100 indicates the upper case, and 101 and 102 indicate the separating pawls. 103 indicates the recording paper, of which leading end corners in the feeding direction engage with the separating pawls.

In general, the recording sheet includes tolerances in the longitudinal and transversal dimensions because of errors generated in the cutting work. An internal dimension L1 of the recording paper containing portion of the upper case 100 has to include a gap, even to a longitudinal dimension corresponding to an upper limit tolerance (Lmax) of the recording sheet. Therefore, the gap increases in case of a sheet of which the longitudinal dimension L corresponds to a lower limit of the tolerance.

FIG. 20B shows a state where the recording sheet has a longitudinal dimension L corresponding to the lower limit of tolerance (Lmin) and such recording sheet is displaced to the right-hand side within the cassette 100. In such case, an engaging amount X1 on the separating pawl 101 at the right side of the recording sheet 103 and an engaging amount X2 on the separating pawl 102 at the left side are significantly different.

For example, in the case that the tolerance of the longitudinal dimension L is ±0.5 mm as shown in FIG. 20B, the dimensional difference is 1.0 mm between the recording sheet corresponding to the upper limit (Lmax) of the dimensional tolerance and the recording sheet corresponding to the lower limit (Lmin) of the dimensional tolerance. Also in the case that the internal dimension of the cassette 100 has a margin of 0.1 mm on each side, the gap will become 1.2 mm for a recording sheet corresponding to the lower limit (Lmin) of the dimensional tolerance. Therefore the difference between the engaging amounts X1, X2 on the separating pawls 101, 102 becomes 1.2 mm.

No problem will arise in the case where the engaging amounts on the separating pawls are so large that such difference is negligible, but, in the case of using a recording sheet of such size and quality as to print a photograph, very large separating pawls cannot be used in consideration of the driving load for separation and the damage to the recording sheet. Therefore, it is difficult to use separating pawls of such a size that can neglect the aforementioned difference of 1.2 mm, since such pawls generates a large difference in the timing of separation in the separating operation for the recording sheets and may become incapable of separating operation in the worst case.

Figure 19A:
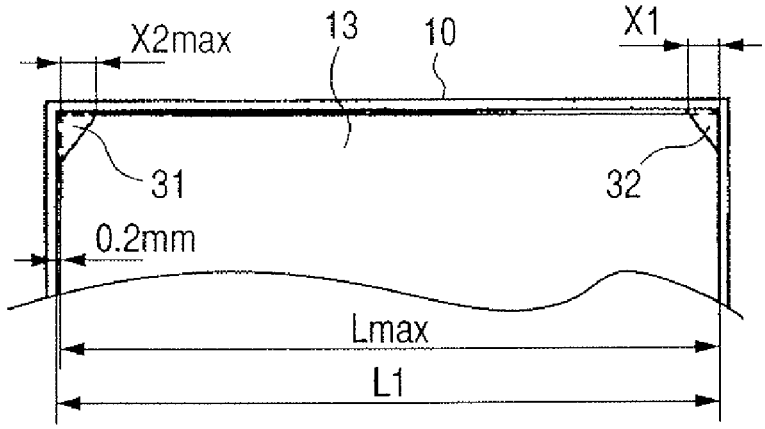
FIGS. 19A, 19B and 19C are views showing a relationship between a separating pawl and a recording sheet, in case of a cassette employing an urging member.
Figure 19B:
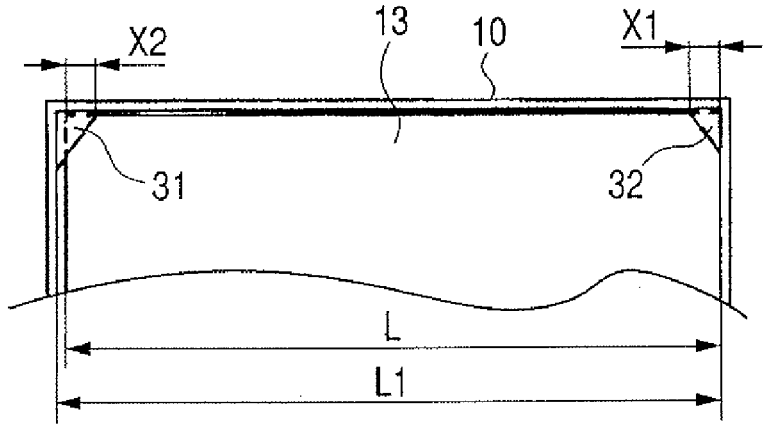
Figure 19C:
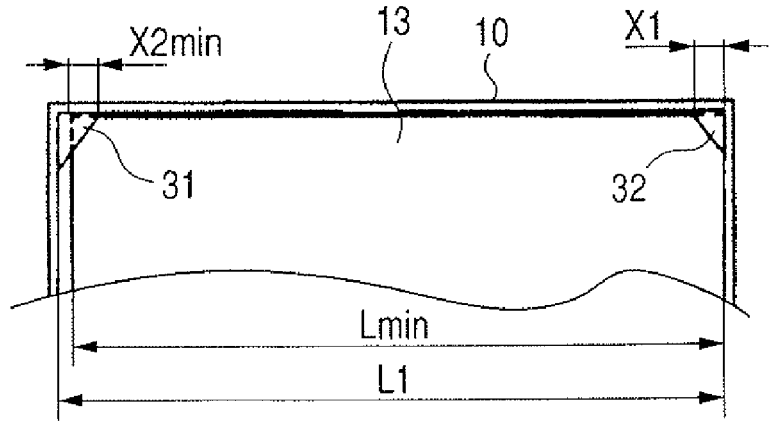

In the following, explained is a cassette 1 adapted for the urging member 50 of the present invention, with reference to FIGS. 19A to 19C, which are also simplified for the purpose of clarity. FIGS. 19A to 19C show a relationship among the recording sheet 13 and the separating pawls 31, 32, seen from the side of the feeding aperture 30 of the cassette 1. FIG. 19A shows a case where the longitudinal dimension L of the recording sheet corresponding to the upper limit (Lmax) of the tolerance. The recording sheet containing portion of the upper case 10 has a longitudinal dimension L1 capable of containing, with a certain margin, even for the recording sheet 13 of a longitudinal dimension L corresponding to the upper limit tolerance. In the present example, the dimension is so selected as to provide a gap of 0.2 mm, when the longitudinal dimension L of the recording sheet 13 corresponds to the upper limit of the tolerance, as illustrated.

FIG. 19B shows a case where the longitudinal dimension L corresponds to a nominal dimension, and FIG. 19C shows a case where the longitudinal dimension L corresponds to the lower limit (Lmin) of the tolerance. In FIGS. 19A to 19C, the left-hand side in the drawing corresponds to the mounting direction of the cassette 1, and the right-hand side in the drawing corresponds to the extracting direction of the cassette 1. Therefore, the urging member 50 urges the recording sheet 13 in a direction from left to right, thereby causing it to impinge on an internal wall at the right-hand side of the upper case 10.

As to the dimensions of the separating pawls 31 and 32, the separating pawl 31 is selected larger than the separating pawl 32, in such a manner that the engaging amounts X1, X2 on the recording sheet 13 become equal when the longitudinal dimension L is the nominal dimension, as shown in FIG. 19B. As the separating pawls 31, 32 are selected in such a manner and as the recording sheet 13 is urged by the urging member 50 toward the separating pawl 32, the difference between the engaging amounts X1, X2 of the separating pawls 31, 32 with the recording sheet 13 remains within the tolerance of the longitudinal dimension L, against the fluctuation of the longitudinal dimension L within such tolerance.

For example, when the recording sheet corresponds to the upper limit (Lmax) of the tolerance as shown in FIG. 19A, an engaging amount X2max on the separating pawl 31 becomes larger than the engaging amount X1 on the separating pawl 32 by an amount corresponding to the tolerance of the longitudinal dimension L of the recording sheet 13. For example, in the case that the tolerance of the longitudinal dimension L is ±0.5 mm, the engaging amount X2max becomes larger by 0.5 mm than the engaging amount X1.

On the other hand, at the lower limit (Lmin) of the tolerance, the engaging amount X2 min on the separating pawl 31 becomes smaller than the engaging amount X1 on the separating pawl 32 by an amount corresponding to the tolerance in the longitudinal dimension L of the recording sheet 13, so that the engaging amount X2 min becomes smaller by 0.5 mm than the engaging amount X1.

Therefore, while the structure without the urging member 50 generates a difference of 1.2 mm between the left and right engaging amounts on the separating pawls, the cassette 1 adapted for the urging member 50 of the present invention can suppress such different to 0.5 mm, equal to the dimensional tolerance in the recording sheet, thereby reducing the difference in the timing of separation in separating the recording sheets by the separating pawls, and avoiding troubles such as a failure in separation.

Figure 21:
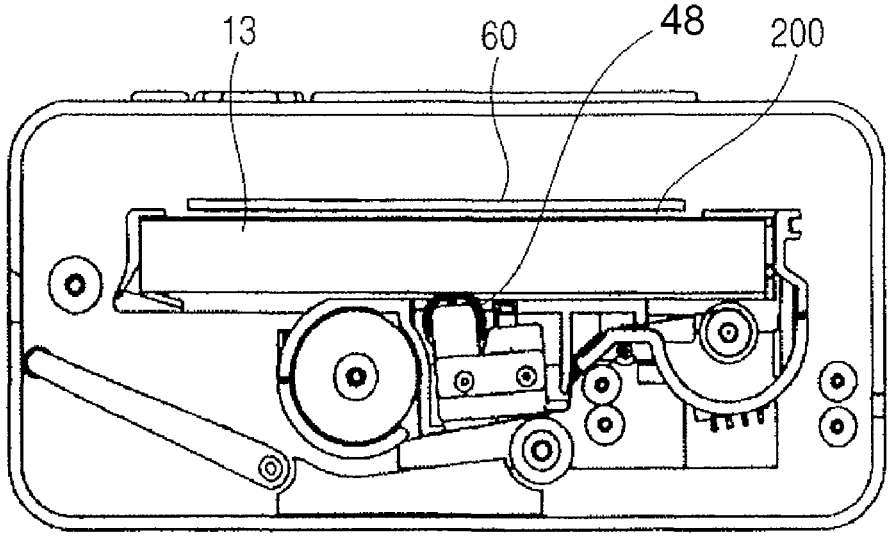
FIG. 21 is a view showing a printer operation.

Now reference is made to FIGS. 21 to 27 for explaining the function of the printer 40. FIG. 21 shows a stand-by state prior to printing, where the cassette 1 is mounted on the printer 40. 60 indicates a pressure plate serving as pressurization means (pressing means), serving to press the recording sheets 13 toward the feeding roller 14 at the sheet feeding. In the stand-by state shown in FIG. 21, the pressure plate 60 is in a position separated from the recording sheets 13. From this state, the pressure plate 60 is moved downwards to press, through the upper aperture 200, the recording sheets 13 under a predetermined pressure, and, by a counterclockwise rotation of the feeding roller 14, one recording sheet 13 alone, in contact with the feeding roller 14, is moved leftward in the drawing and is subjected to a separation by the pawls, whereby the recording sheet 13 is fed through the feeding aperture 30.

Figure 22:
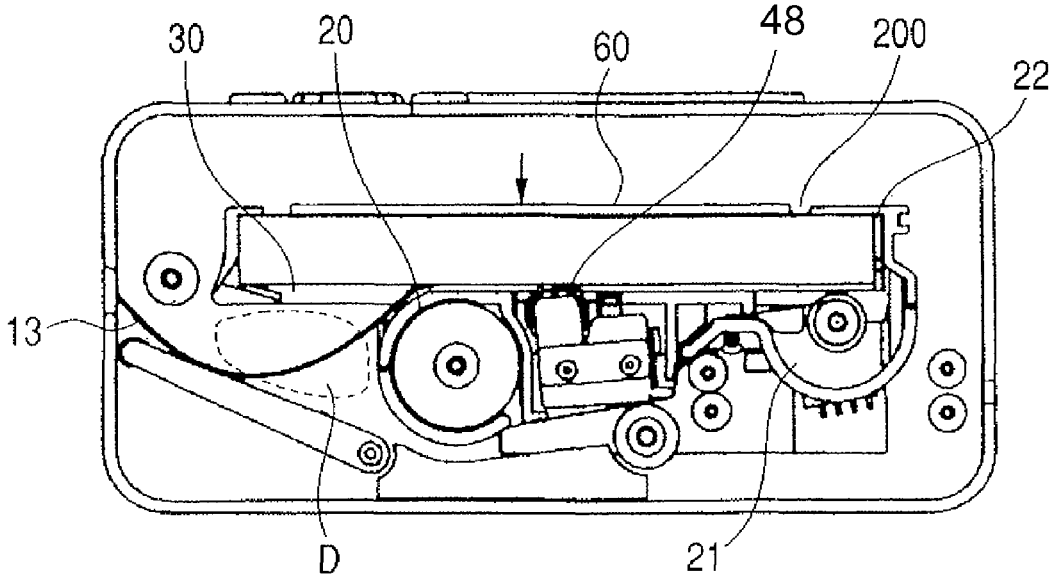
FIG. 22 is a view showing a printer operation.

FIG. 22 shows a state where the fed recording sheet 13 is advanced by a certain amount from the cassette 1. As illustrated, the recording sheet 13 emerges from the feeding aperture 30, bending along the first containing portion 20 for the ink sheet 12. The recording sheet 13, being a paper suitable principally for photograph printing and causing a damage or creases on a printing surface when bent extremely, can bend mildly as illustrated, in a space D at the left of the first containing portion and under the feeding aperture 30.

Also the feeding roller 14 can drive the recording sheet 13 at the approximate center thereof and can secure a sufficient bending length for the recording sheet 13, thereby improving the reliability of separation and not causing an extreme bending in the recording sheet 13 to minimize the damage to the recording sheet 13. The aforementioned space D can be secured, by positioning the second containing portion 21 for the ink sheet at the right-hand side in the drawing to the recording sheet containing portion 22.

Also the feeding roller 14 is provided in the head unit 45 to achieve a compactification of the apparatus, and the upper aperture 200, for loading and pressurizing the recording sheets 13, is provided at the opposed side to enable an efficient pressurization.

Figure 23:
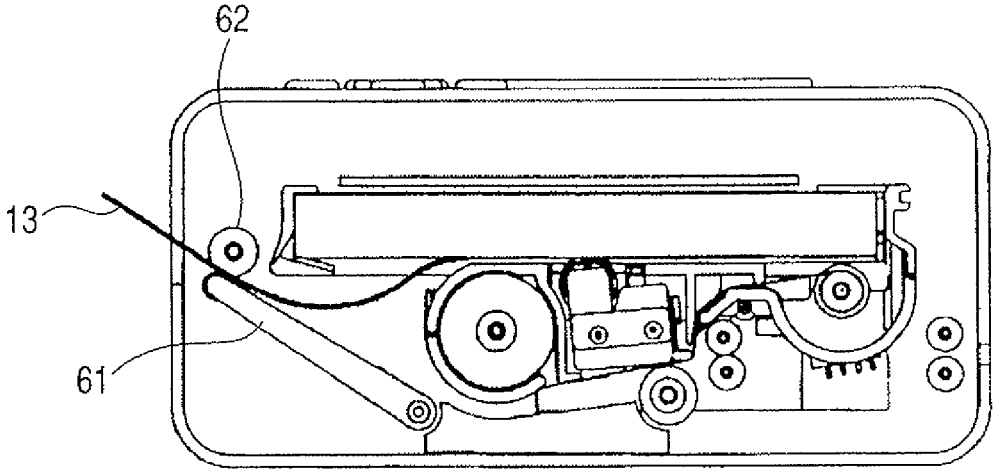
FIG. 23 is a view showing a printer operation.
Figure 24:
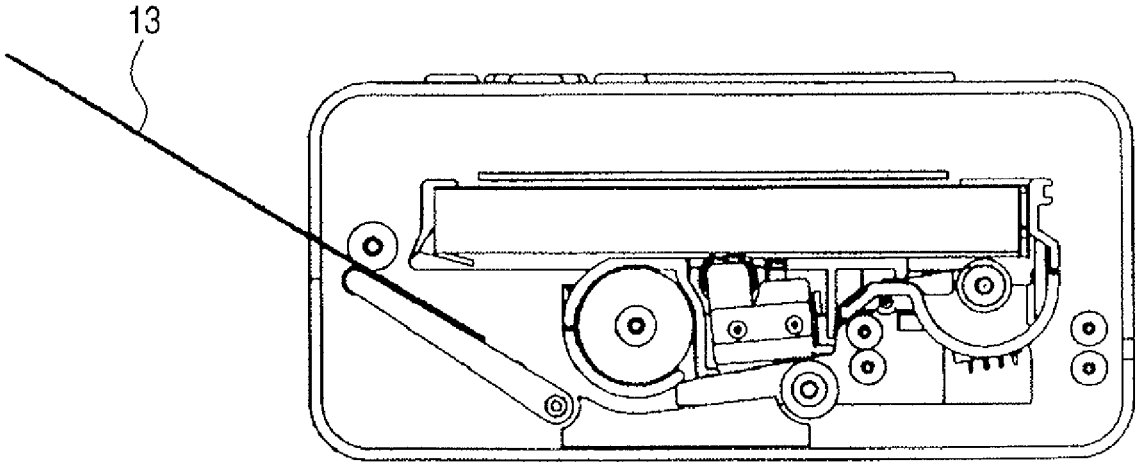
FIG. 24 is a view showing a printer operation.

After the recording sheet 13 is advanced by a predetermined amount, the recording sheet 13 is pressed to first rollers 62 constituting conveying means by a roller plate 61 as illustrated in FIG. 23, and is further extracted from the cassette 1 by the rotation of the first roller 61. FIG. 24 shows a state where the recording sheet 13 is completely extracted from the cassette 1 and is further advanced by a predetermined amount. From such state, the recording sheet 13 is rotated about an axis perpendicular to the surface of the recording sheet 13.

Figure 25:
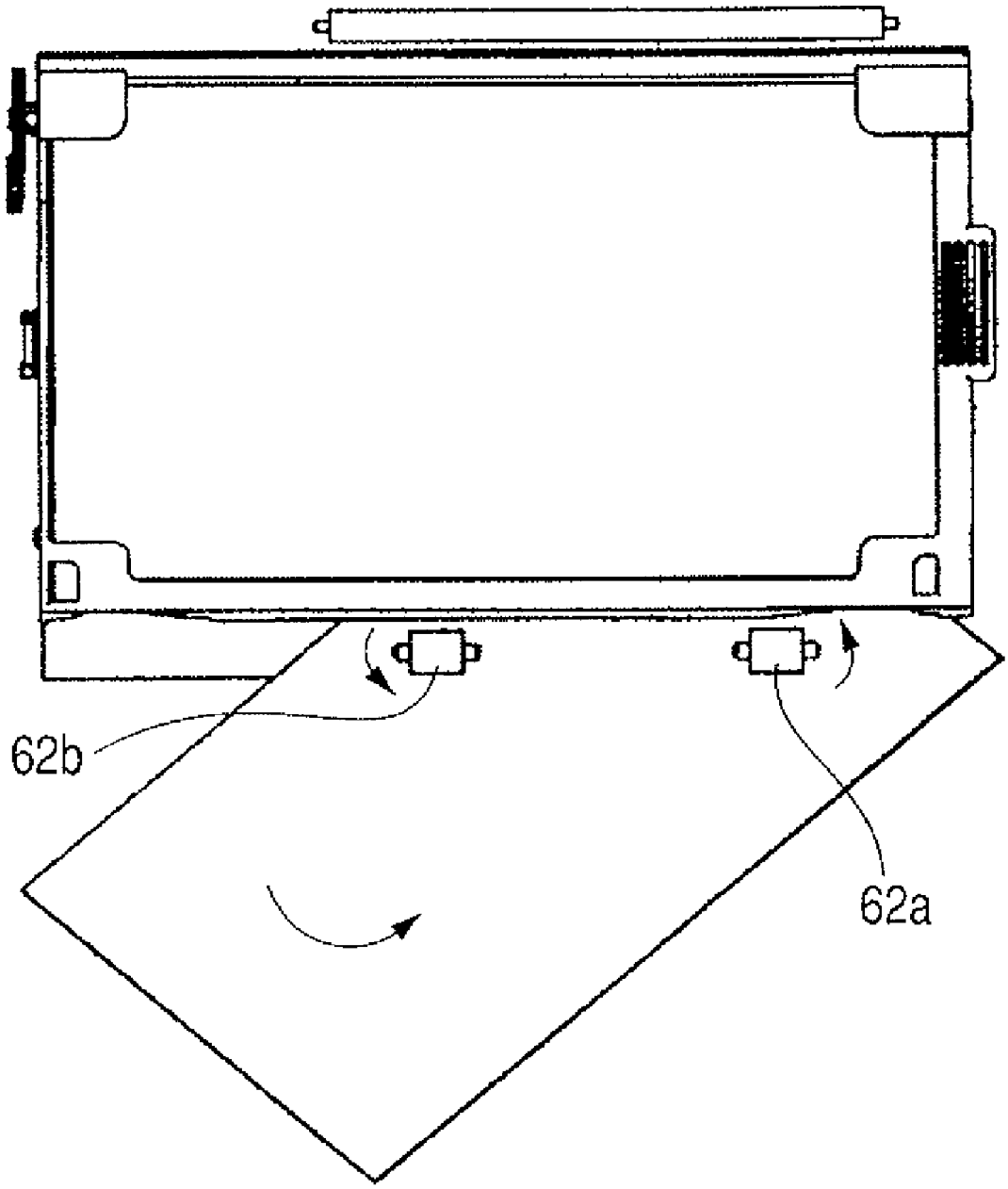
FIG. 25 is a view showing a printer operation.
Figure 26:
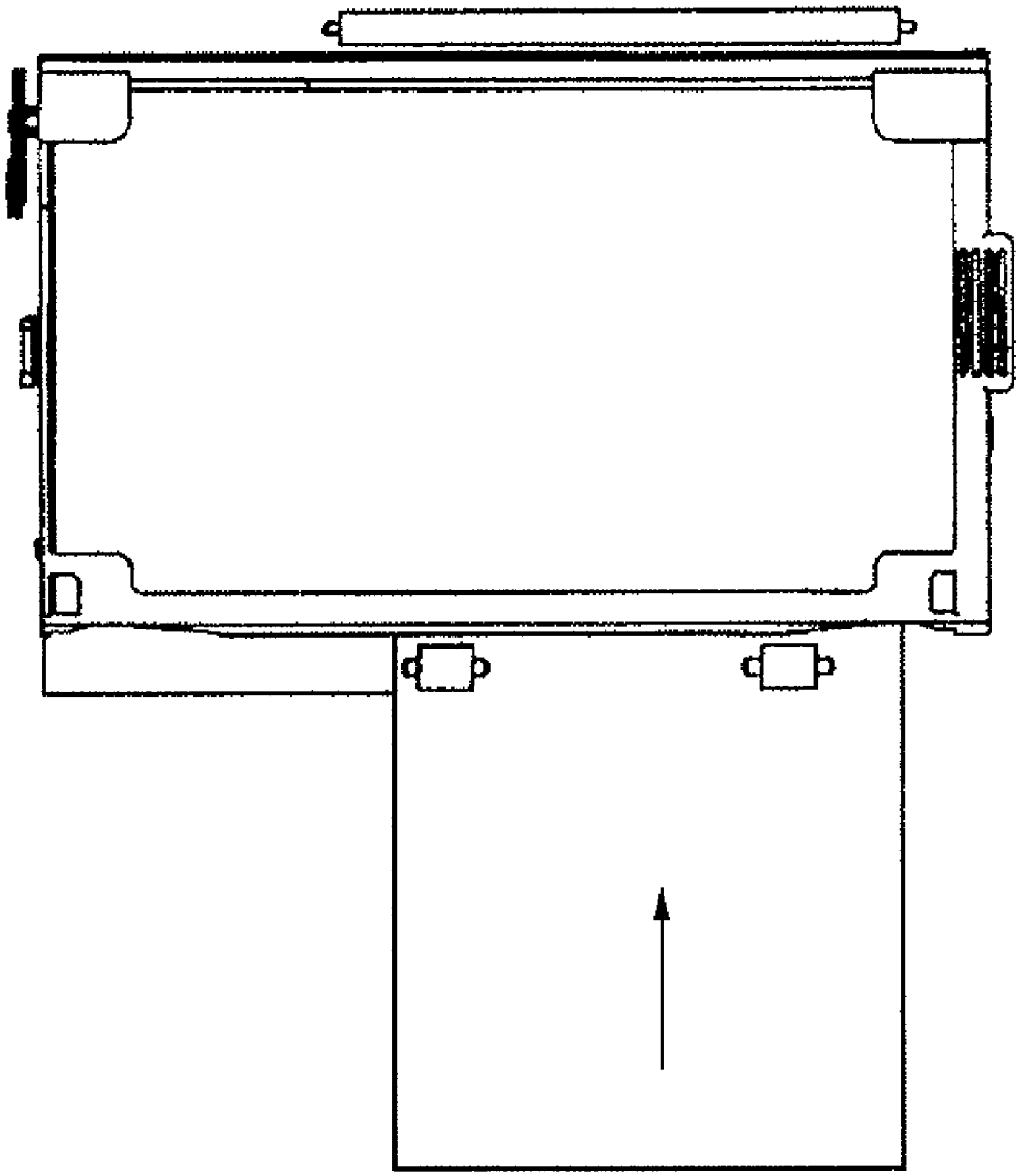
FIG. 26 is a view showing a printer operation.

FIG. 25 shows a state in the course of the rotation. The rotation of the recording sheet 13 is executed by rotating the first rollers provided in two units, in mutually opposite directions. The first roller 62*a* is rotated in a direction to pulling the recording sheet 13 into the printer 40, and the first roller 62*b* is rotated in a direction toward the exterior of the printer 40. FIG. 26 shows a state where the rotation is completed. From such state, the recording sheet 13 is conveyed by the first rollers 62*a*, 62*b* into the printer 40 and is transferred to a printing operation. In this manner, upon completion of the rotation, the conveying direction is changed from the conveying direction in the feeding operation.

The roller plate 61 and the rollers 62*a*, 62*b* used for conveying the recording sheet 13 are advantageously provided in the space D, formed by providing the second containing portion 21 for the ink sheet along the right-hand side in the drawing of the recording sheet containing portion 22, thereby achieving the compactification of the printer 40. Also, since the feeding aperture 30 is provided outside the first containing portion 21 which is at the upstream side in the conveying path at the printing operation, the recording sheet 13 can be smoothly transferred to the conveying for printing operation, without a wasteful conveyance.

Figure 27:
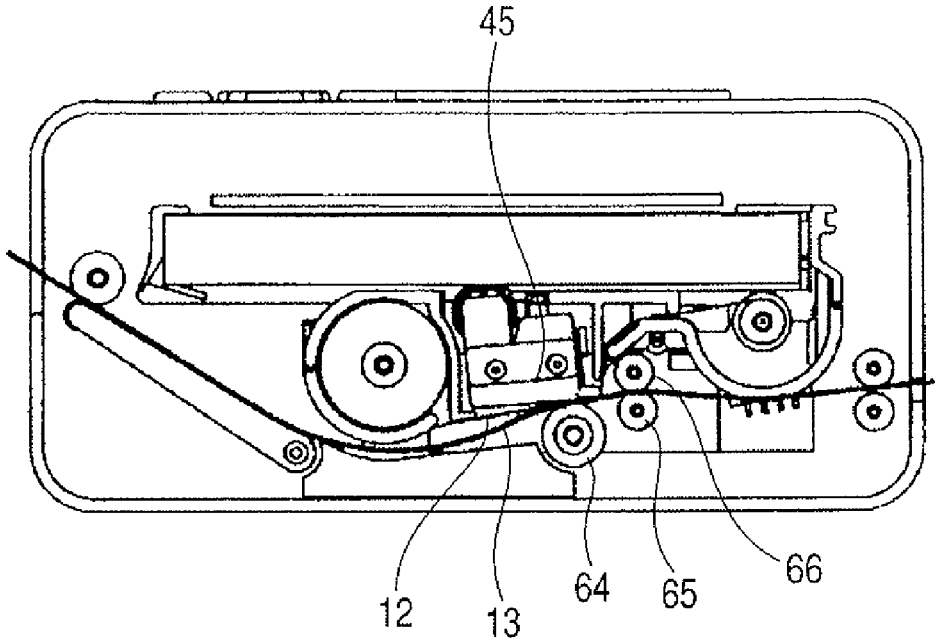
FIG. 27 is a view showing a printer operation.

FIG. 27 shows a printing state. The printing operation is executed by pressurizing the ink sheet 12 and the recording sheet 13 by the thermal head 45 and the platen roller 64, and by conveying the recording sheet 13 by a capstan roller 65 and a pinch roller 66 provided in pair in the downstream side in the printing direction, under a thermal transfer of the ink of the ink sheet 12 onto the recording sheet 13 by a heat generated by the thermal head 45. At the printing operation, the recording sheet 13 is conveyed at a side opposite to the feeding aperture 30 with respect to the ink sheet 12. After the printing of a first color, the pressurization by the thermal head 45 is released, then the capstan roller 65 and the pinch roller 66 are rotated in a direction opposite to that during the printing operation to return the recording sheet 13 to a print start position, and second and subsequent colors are printed in the same manner as in the printing of the first color. Thus a full-color printing is executed by superposing three colors of yellow, magenta and cyan.

Upon completion of the printing, the recording sheet 13 is discharged to an exterior at the right-hand side of the printer 40. The user, in executing the printing operation, can repeat the above-described operation until the recording sheets 13 and the ink sheet 12 contained in the cassette 1 are used up. As the recording sheets 13 and the ink sheet 12 are contained for a same number of printings, neither of these will be used up earlier. The printer of the present invention is so constructed as to detect absence of the recording sheet 13 and to suspend the printing operation.

In the following, a method of detecting presence/absence of the recording sheet 13 will be explained with reference to FIGS. 28A, 28B and 29. FIG. 28B shows a state where the recording sheets 13 still remain in a sufficient amount. As shown in FIG. 28B, a photoreflector 53 is provided in a direction, substantially opposed to the recording sheet 13. Upon execution of the printing operation, the pressure plate 60 is pressed to the recording sheets 13, which are thus pressed to the photoreflector 53. The photoreflector 53 emits an infrared light and detects the light reflected by a rear surface of the recording sheet 13. The recording sheet 13, generally white, has a relatively high reflectance and can be easily detected. Also a highly reliable detection is possible by executing the detecting operation only when the pressure plate 60 is in the pressing position.

Figure 28A:
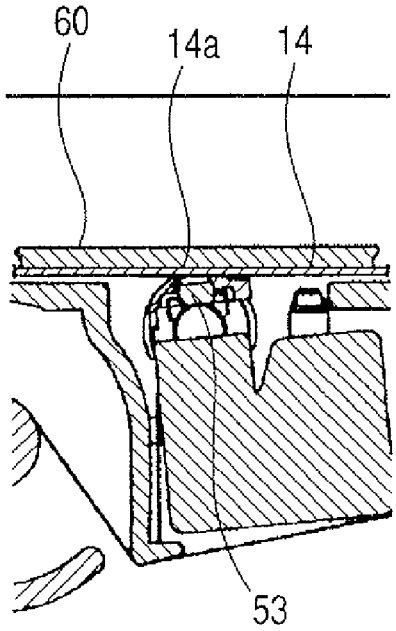
FIGS. 28A and 28B are views showing a method for detecting presence/absence of the recording sheet.
Figure 28B:
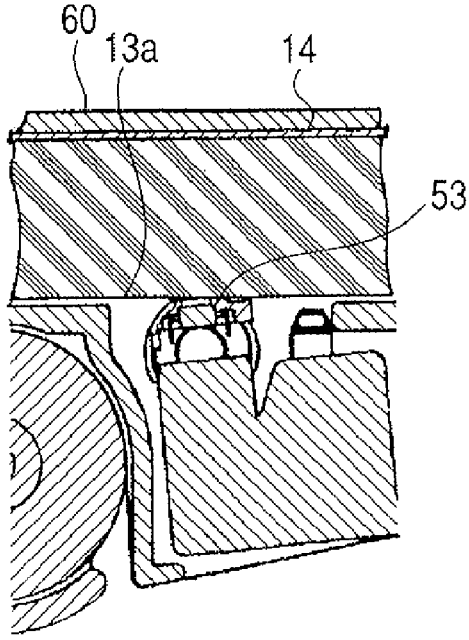
Figure 29:
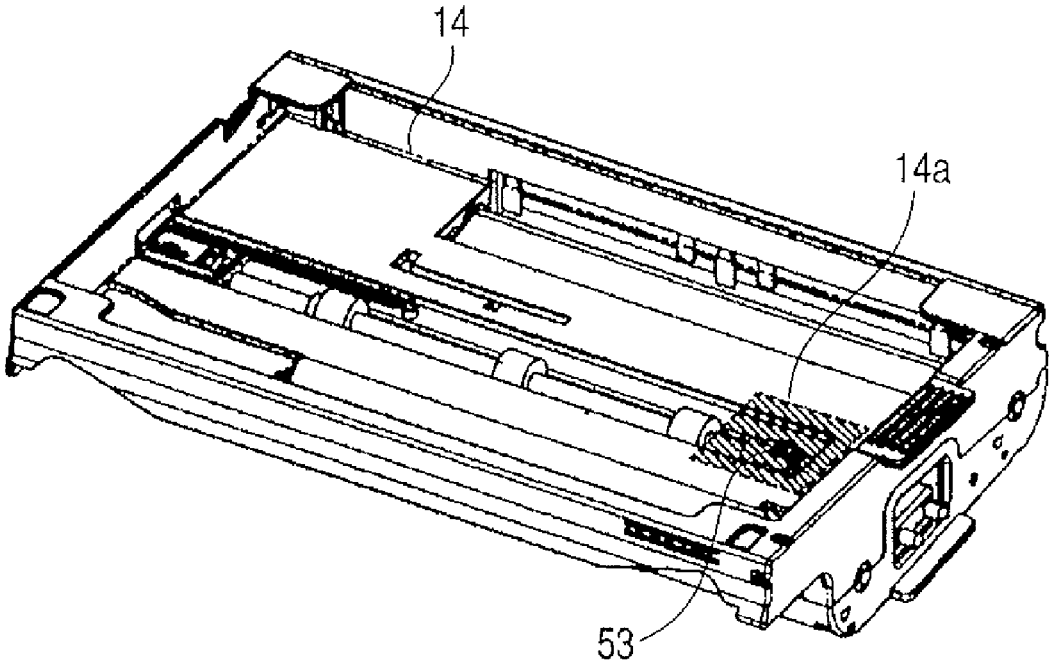
FIG. 29 is a view showing a method for detecting presence/absence of the recording sheet.

FIG. 28A shows a state where a printing operation is executed when the recording sheet 13 is absent and the protective sheet 14 alone remains, where presence/absence of the recording sheet 13 is detected with the pressure plate 60 in the pressing position. As shown in FIG. 29, the protective sheet 14 has, in a portion opposed to the photoreflector 53, a print 14*a* with an ink having a low reflectance to the infrared light, for example a black print, so that the photoreflector 53 is unable to detect the reflected light thereby judging the absence of the recording sheet 13. This example employs a printing of a low reflectance, but the object can be similarly attained by forming a hole, of a size similar to the printed area, instead of the printing, as the reflected light cannot be detected in a similar manner.

Figure 30:
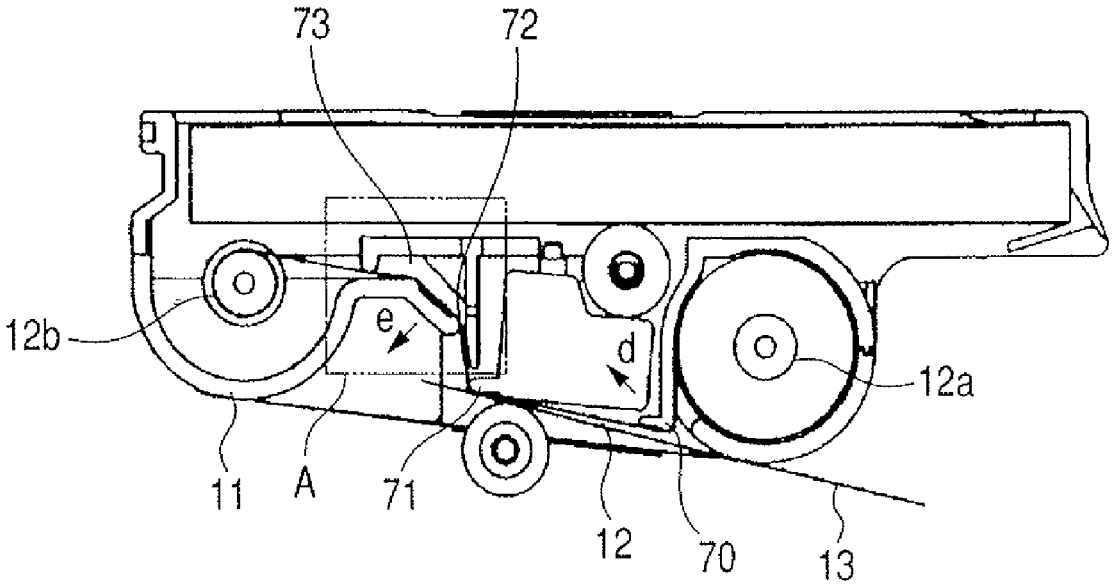
FIG. 30 is a view showing a running state of the ink sheet.

In the following, the running of the ink sheet 12 at the printing operation will be explained. FIG. 30 is a view showing a running path of the ink sheet 12 at the printing operation, seen from the side of the main body of the printer 40. The ink sheet 12, wound on the first bobbin 12*a* at first turns toward the thermal head 47 by a first guide 70 of the upper case, then subjected to a printing by the thermal head 47, and is peeled off from the recording sheet 13 by a peeling plate 71. Then it further turns by a second guide 72 and a third guide 73 of the lower case 11 and is wound up by the second bobbin 12*b*. As the ink sheet 12 is required to have a certain tension during the printing operation, a predetermined torque is applied to the first bobbin 12*a* for example by a frictional spring. A tension is also applied in peeling from the recording sheet 13 by the peeling plate 71.

Therefore, loads are applied to the upper case 10 in a direction indicated by an arrow d, and to the lower case 11 in a direction indicated by an arrow e. These loads function as a twisting load on the upper case 10 and the lower case 11, as a moment about the first bobbin 12*a* and the second bobbin 12*b*. The upper case 10 and the lower case 11, being formed by injection molded plastics as described above and due to presence of the feeding aperture 30 for feeding the recording sheet 13 and the aperture 34 for the feeding roller 48 and the photoreflector 53, are weaker in rigidity and liable to be deformed particularly around the supply side containing portion 20. Also in the proximity of the winding side containing portion 21, the second guide 72 and the third guide 73 of the lower case 11 are subjected to a large load by the aforementioned tensions and the winding torque.

Figure 31:
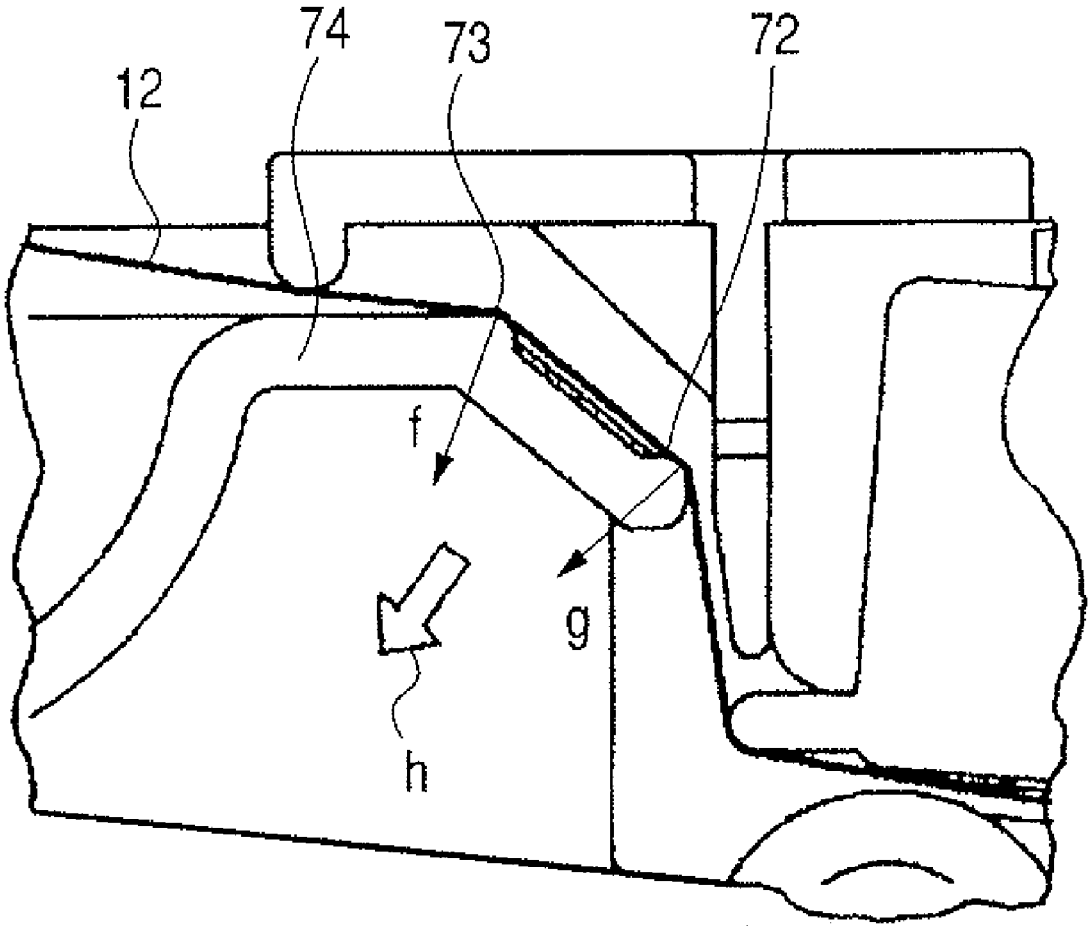
FIG. 31 is a view showing a running state of the ink sheet.
Figure 32A:
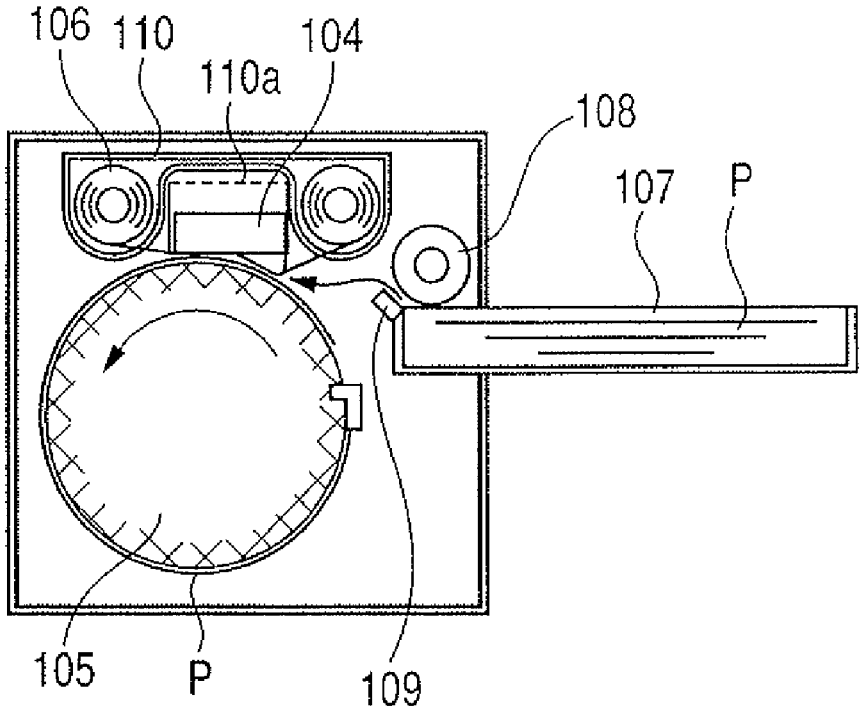
FIGS. 32A and 32B are views showing a first example of a common structure of a prior thermal transfer printer.
Figure 32B:
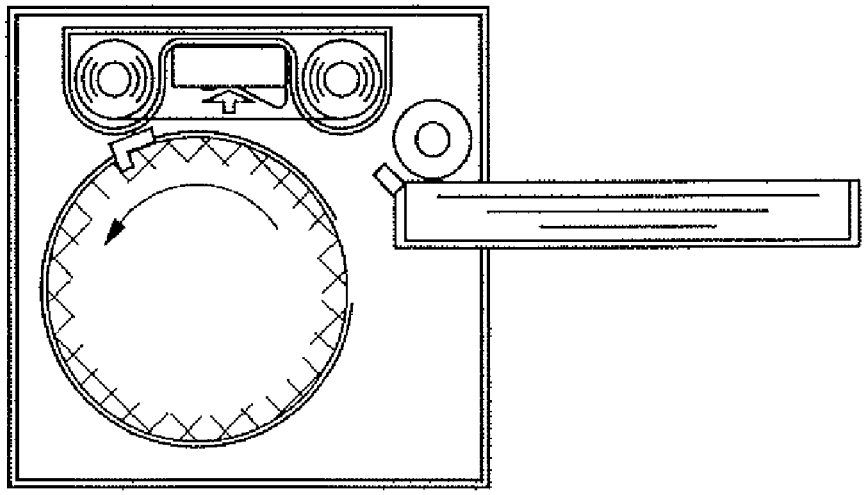
Figure 33A:
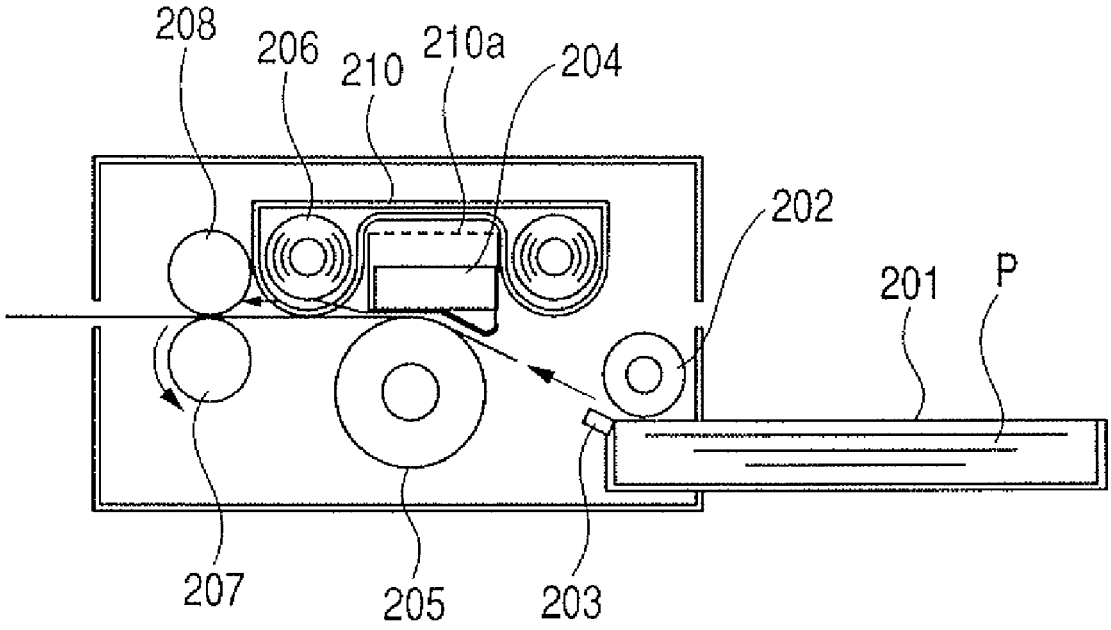
FIGS. 33A and 33B are views showing a second example of the common structure of the prior thermal transfer printer.
Figure 33B:
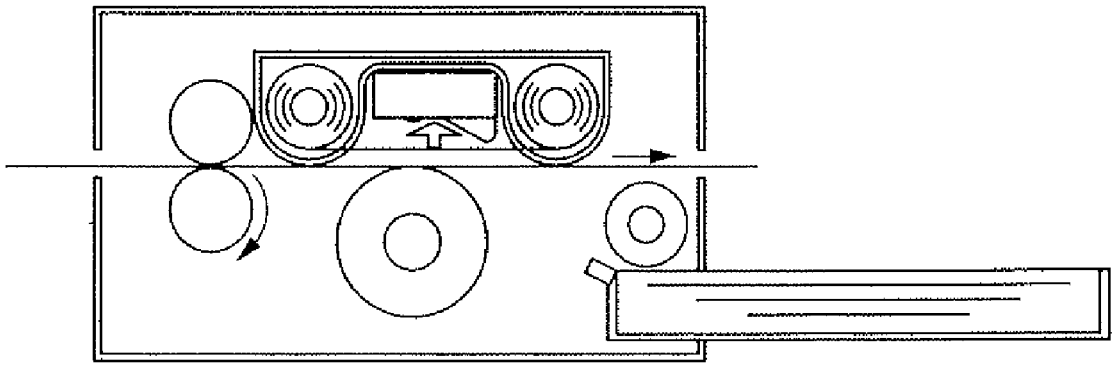
Figure 34:
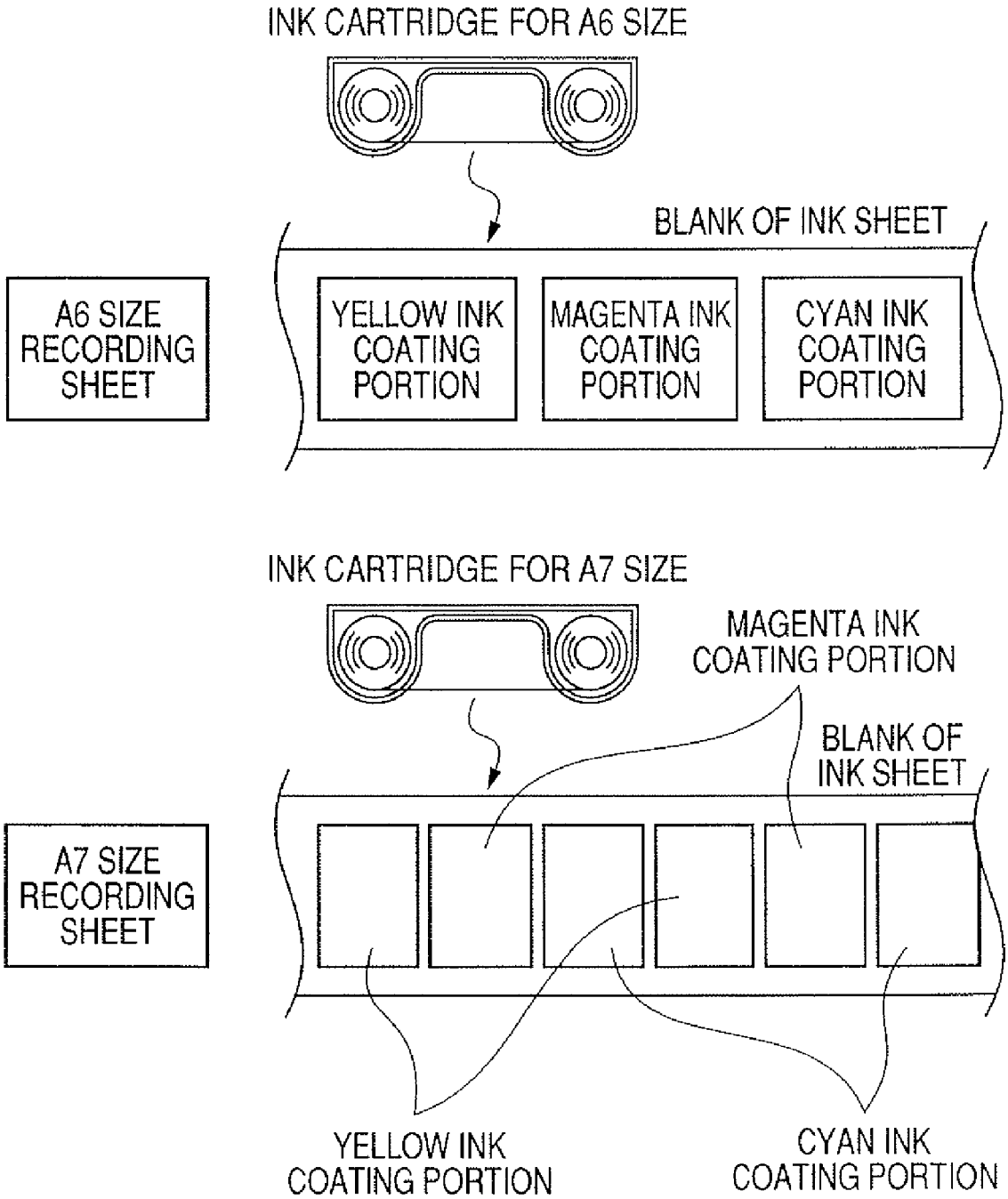
FIG. 34 is a view showing a relationship between a recording sheet size and a coated portion of the ink sheet.

FIG. 31 is a detailed view of a portion A in FIG. 30. As illustrated, the second guide 72 and the third guide 73 are subjected to loads indicated by arrows g, f, so that a portion around the second guide 72 and the third guide 73 tends to be flexed in a direction indicated by an arrow h, with respect to a portion 74 of the lower case.

A deformation in the upper case 10 and the lower case 11 induces a distortion in the running path of the ink sheet 12, thus hindering a stable running thereof. When the stable running is hindered, the winding on the second bobbin 12*b* involves a skewing and induces creases. The creases, if spread to the printing path, may result in a serious problem for the printer of causing creases on the printing surface. It is therefore very important to stabilize the running path of the ink ribbon 12.

In the cassette 1 of the present invention, as described above, the first positioning hole 35 is provided on the end face of the supply side containing portion 20 for the ink sheet, and the second positioning hole 36 is provided in the proximity of the end face of the winding side containing portion 21. When the cassette 1 is mounted on the printer 40, these respectively engage with the first positioning shaft 56 and the second positioning shaft 57, thereby preventing the deformation against the aforementioned twisting load and stabilizing the running path of the ink sheet 12.

Furthermore, the shaft 35 provided in the upper case 10 and the hole 36 provided in the lower case 11 are bonded by thermal fusion to elevate the integrality of the proximity of the second guide 72 and the third guide 73 of the lower case 11 with the upper case 10, thereby further increasing the rigidity and further stability the running path.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-041768, filed Feb. 20, 2006, which is hereby incorporated by reference herein in its entirety.

What is claimed is:

1. A cassette for containing a recording sheet and an ink sheet and being detachably mountable in a main body of an apparatus, said cassette comprising:

a recording sheet containing portion configured to contain the recording sheet, including a feeding aperture permitting feeding of the contained recording sheet;

a first protruded portion, protruding from a first surface of said recording sheet containing portion and configured to contain therein the ink sheet wound on a first shaft; and a second protruded portion, protruding from the first surface of said recording sheet containing portion and configured to contain therein a second shaft for winding the ink sheet received from said first protruded portion, wherein a space is provided between said first protruded portion and said second protruded portion and between the ink sheet drawn from the first shaft and said recording sheet containing portion, and the space is configured to receive a thermal head and a feeding roller when said cassette is mounted on the main body of the apparatus, wherein a first aperture is formed at the first surface of said recording sheet containing portion opposed to the ink sheet exposed between said first protruded portion and said second protruded portion and at a position between said first protruded portion and said second protruded portion, so that the feeding roller contacts with the recording sheet in said recording sheet containing portion when said cassette is mounted on the main body of the apparatus, wherein a second aperture is provided at a second surface of said recording sheet containing portion opposed to the first aperture so that when said cassette is mounted on the main body of the apparatus, a pressing portion of the main body of the apparatus for pressing the recording sheet to the feeding roller is in contact with the recording sheet contained in said recording sheet containing portion, wherein a third aperture is provided at the first surface of said recording sheet containing portion provided with the first aperture, and wherein the third aperture, said first protruded portion, the first aperture and said second protruded portion are provided on the first surface in this order.

2. The cassette according to claim 1, wherein, when said cassette is mounted on the main body of the apparatus, the recording sheet to which the ink of the ink sheet is to be transferred, is conveyed by a side thereof opposite to the space occupied by the ink sheet, which is exposed between said first protruded portion and said second protruded portion.

3. The cassette according to claim 1, wherein a separating pawl is provided at the third aperture, the separating pawl configured to separate the contained recording sheets.

4. A printer apparatus capable of detachably mounting a cassette containing a recording sheet and an ink sheet and including a recording sheet containing portion configured to contain a recording sheet and having a feeding aperture permitting feeding of the contained recording sheet, a first protruded portion, protruding from a first surface of the recording sheet containing portion and configured to contain therein the ink sheet wound on a first shaft, a second protruded portion, protruding from the first surface of the recording sheet containing portion and configured to contain therein a second shaft for winding the ink sheet received from the first protruded portion, and a space provided between the first protruded portion and the second protruded portion and between the ink sheet drawn from the first shaft and the recording sheet containing portion, and the space is configured to receive a recording head and a feeding roller when the cassette is mounted on the main body of said printer apparatus, said printer apparatus comprising:

a feeding roller that feeds the recording sheet through a first aperture formed at the first surface of the recording sheet containing portion opposed to the ink sheet exposed between the first protruded portion and the second protruded portion and at a position between the first protruded portion and the second protruded portion;

a recording head that transfers ink of the ink sheet, which is exposed between the first protruded portion and the second protruded portion, onto the recording sheet;

a pressing portion that presses the recording sheet to said feeding roller through a second aperture, the second aperture being provided at a second surface of the recording sheet containing portion opposed to the first aperture, and conveying means for conveying the recording sheet fed from the recording sheet containing portion to the ink sheet exposed between the first protruded portion and the second protruded portion, wherein a third aperture is provided at the first surface of said recording sheet containing portion provided with the first aperture, and wherein the third aperture, the first protruded portion, the first aperture and the second protruded portion are provided on the first surface in this order.

5. A printer apparatus according to claim 4, wherein said feeding roller feeds the recording sheet from the third aperture provided at the first surface of the recording sheet containing portion where the first protruded portion and the second protruded portion protrude, and wherein said conveying means conveys the recording sheet fed from the third aperture in the same direction as the feeding direction of said feeding roller, and after the recording sheet is fed out of the recording sheet containing portion, said conveying means conveys the recording sheet to the ink sheet exposed between the first protruded portion and the second protruded portion by switching to the direction opposed to the feeding direction of said feeding roller.

* * * * *